US006219506B1

(12) United States Patent
Morinaga et al.

(10) Patent No.: US 6,219,506 B1
(45) Date of Patent: Apr. 17, 2001

(54) DISASSEMBLING METHOD FOR TONER ACCOMMODATING CONTAINER

(75) Inventors: Hiroumi Morinaga, Susono; Toshiaki Nagashima, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/429,484

(22) Filed: Oct. 29, 1999

(30) Foreign Application Priority Data

Oct. 29, 1998 (JP) ..... 10-324554

(51) Int. Cl.[7] ..... G03G 15/00
(52) U.S. Cl. ..... 399/109; 399/119
(58) Field of Search ..... 399/109, 110, 399/111, 119

(56) References Cited

U.S. PATENT DOCUMENTS 4,931,838 6/1990 Ban et al. ..... 355/260
5,110,646 * 5/1992 Prestel ..... 399/109
5,491,542 2/1996 Nagashima et al. ..... 355/260
5,778,282 7/1998 Nagashima ..... 399/106

* cited by examiner

*Primary Examiner*—Quana M. Grainger
(74) *Attorney, Agent, or Firm*—Fitzpatrick, Cella, Harper & Scinto

(57) ABSTRACT

A method of disassembling, for reuse, a toner accommodating container, including a main body for accommodating toner, an opening for permitting filling of the toner and a cap press-fitted with an engaging portion of the opening to plug the opening, the includes a first step of partly cutting the cap without cutting the engaging portion; and a second step of removing the cap from the engaging portion while releasing engagement between the cap and the engaging portion by deforming the cap using a cut portion provided by the cuttin step.

12 Claims, 21 Drawing Sheets

DISASSEMBLING METHOD FOR TONER ACCOMMODATING CONTAINER

FIELD OF THE INVENTION AND RELATED ART

The present invention relates to a disassembling method for disassemblying a toner accommodating container suitable to supply the toner (developer) into the developing device of an image forming apparatus such as an electrostatic copying machine, printer or the like to reuse the container.

Heretofore, an electrophotographic image forming apparatus has been used for a printer, copying machine or the like, wherein the developing device thereof uses developer (toner).

The toner is consumed with the execution of the image forming process, and therefore, the toner should be replenished timely.

For the toner supply, the use is made of a toner accommodating container (toner container), and the toner container is used not only for a copying machine wherein the toner is supplied therefrom all at onec, but also for a printer as terminal equipment of information equipment, such as a computer, facsimile machine, CAD or the like.

It is used also for a process cartridge.

The toner container is provided with a filling port for permitting filling of the toner into the container, and the filling port is plugged and sealed by a toner cap. Generally, the toner cap is made of low density polyethylene (LDPE) and is produced by injection molding. The toner cap is provided with several ribs around the cylindrical portion thereof so that it is press-fitted into the filling port.

In a recent example, a projected edge is formed all around the engaging portion of the filling port, and on the other hand, a groove is formed in the cap, wherein the edge of the filling port bites into the groove portion to accomplish sealing press-fitting.

For the reuse of the toner container and for the reuse of the members, they are crushed and reused as a molding material.

For example, in the case of a cap having several ribs provided on the cylindrical portion of the toner cap so as to provide press-fitting relative to the inner surface of the filling port of the toner container to accomplish the sealing, a flange portion of the cap is nipped and removed by a tool such as pench, plier or the like.

In a recent example, a projected edge portion is formed all around the portion of the filling port which is engaged with the cap, and a groove into which the edge portion of the filling port bites is formed all around the engaging surfaces of the cap to accoomplish press-fitting and sealing. In this case, the cap is not easily dropped during transportation, but correspondingly, it is difficult to remove the cap by nipping and pulling.

Therefore, a jig for cap removal is inserted through the toner discharging outlet of the toner container so that a force is imparted from the inside of the toner container to remove the cap.

However, when the cap is removed from the toner container and the process cartridge through the conventional method, the following problems arise.

In the case of the cap wherein several ribs are provided on the cylindrical portion of the toner cap, and the cap is press-fitted into the filling port of the toner container to effect the sealing, the cap is nipped and pulled by a tool capable of nipping the edge of the cap (for example, a pench or plier or the like). The edge of the filling port may be nipped by mistake, or the edge of the filling port may be inadvertenty dameged.

In the worst case, the chips are deposited on the toner container, and the chips may remain in the assembled parts.

In the case of the above-described recent cap, a jig for the cap dismounting is inserted through the toner discharging outlet of the toner container, and a force is imparted to the cap from the inside of the toner container. However, if the used toner containers or process cartridges are disassembled without classification all in a single disassembling operation line (to minimize the classification cost), two types of operations have to selectively be carried out, namely, "nipping and pulling the cap" or "removing the cap from the inside of the toner container using a jig."

In the case of the cap sealing the filling port, the "removing the cap from the inside of the toner container using a jig." can be fundamentally used for all cases, but the disassemblying setup has to be modified in view of the difference in shapes of the toner containers or the process cartridges, the difference of the filling ports in the positions and configurations, and the difference in the tools to be used for the dismounting.

It is the fact that toner containers and the process cartridges are not returned with classification.

It would be possible to classify the returned toner containers and process cartridges before the disassemblying process. But, it is costly, and it requires to provide different disassembling lines.

SUMMARY OF THE INVENTION

Accordingly, it is a principal object of the present invention to provide a disassembling method for a toner accommodating container wherein an edge of the filling port is protected from damage or scraping when the cap is dismounted.

It is another object of the present invention to provide a disassembling method wherein the toner accommodating container can be disassembled efficiently without damage to the main body of the container irrespective of the configuration of the cap.

While the invention have been described with reference to the structures disclosed herein, it is not confined to the details set forth and this application is intended to cover such modifications or changes as may come within the purposes of the improvements or the scope of the following claims.

DESCRIPTION OF THE PREFERRED EMBODIMENTS

A description will be provided as to the embodiments of the present invention in conjunction with the accompanying drawings.

In the following description, the short side direction of the process cartridge B is the direction in which the process cartridge B is mounted to or demounted from the main assembly 14 of the apparatus, and which is the same as the feeding direction of the recording material.

The longitudinal direction of the process cartridge B is a direction crossing with the direction of mounting and dismounting of the process cartridge B relative to the main assembly 14 of the apparatus (substantially perpendicular), and is parallel with the surface of the recording material, and crosses with the feeding direction of the recording material (substantially perpendicular).

The terms "left and right" of the process cartridge refers to the directions "left and right" in the same direction as the feeding direction of the recording material as seen from the top of the recording material.

Figure 1:
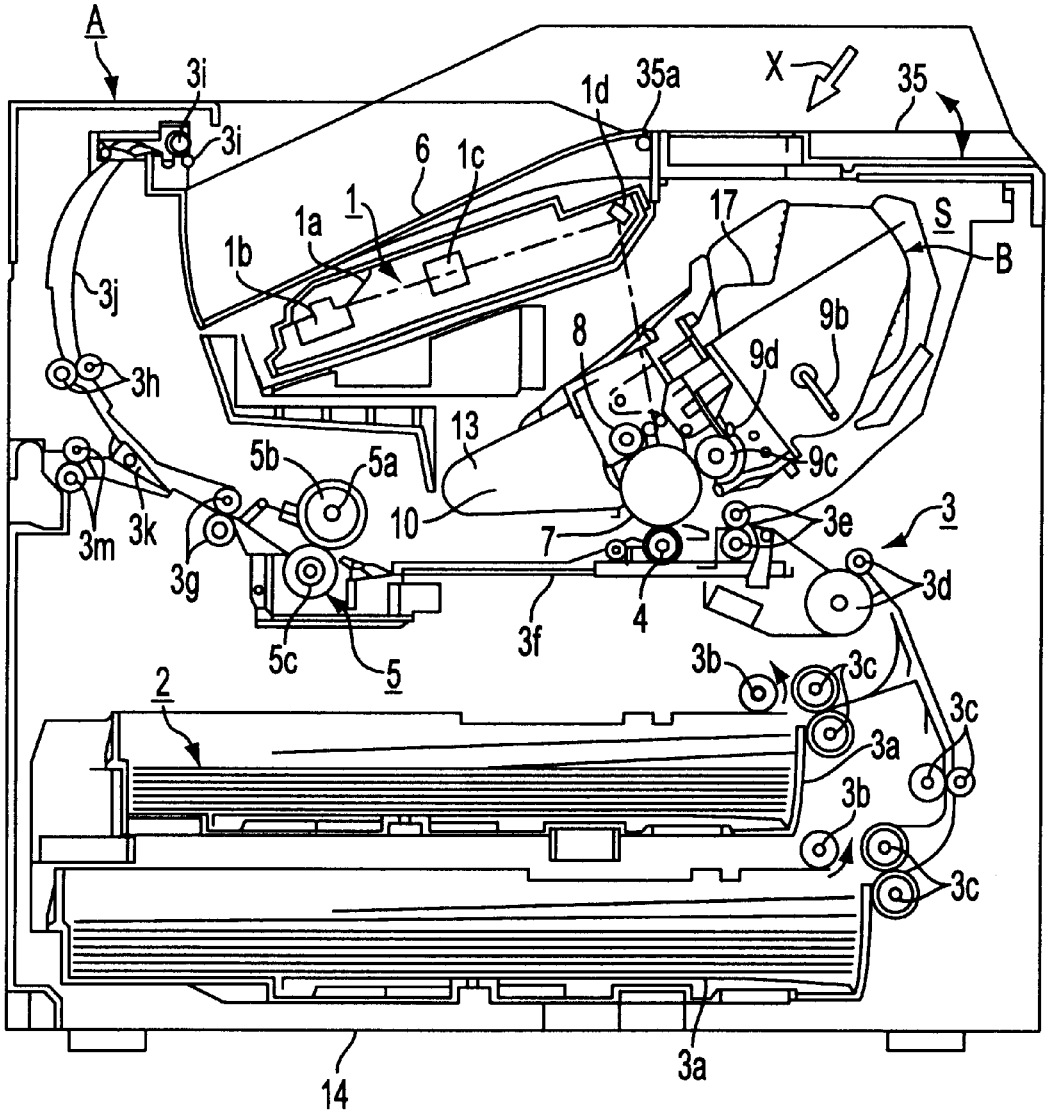
FIG. 1 is a longitudinal sectional view of an electrophotographic image forming apparatus (laser beam printer) according to the embodiment of the present invention.
Figure 2:
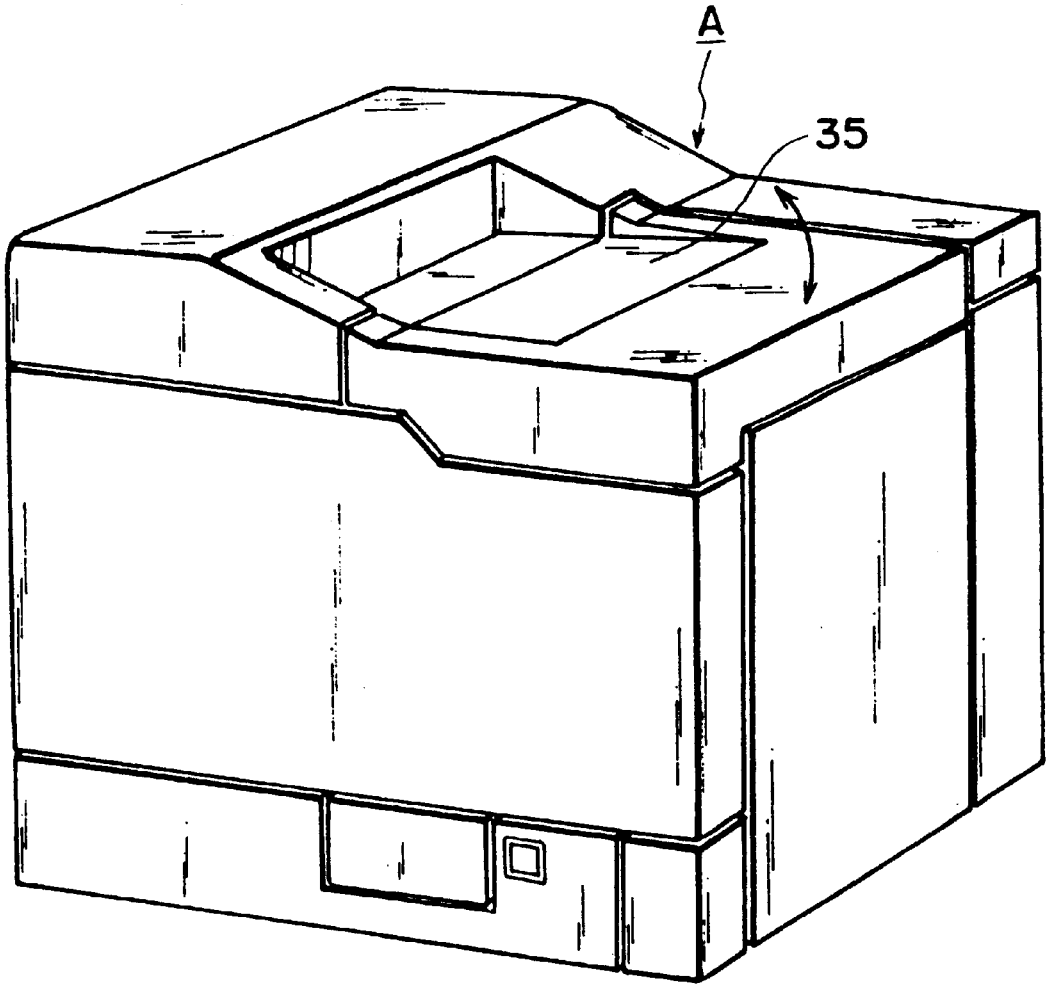
FIG. 2 is a perspective view showing the outer appearance of the electrophotographic image forming apparatus shown in FIG. 1.

FIG. 1 is an illustration of an electrophotographic image forming apparatus (laser beam printer) according to an embodiment of the present invention, and FIG. 2 is a perspective view of an outer appearance.

Figure 3:
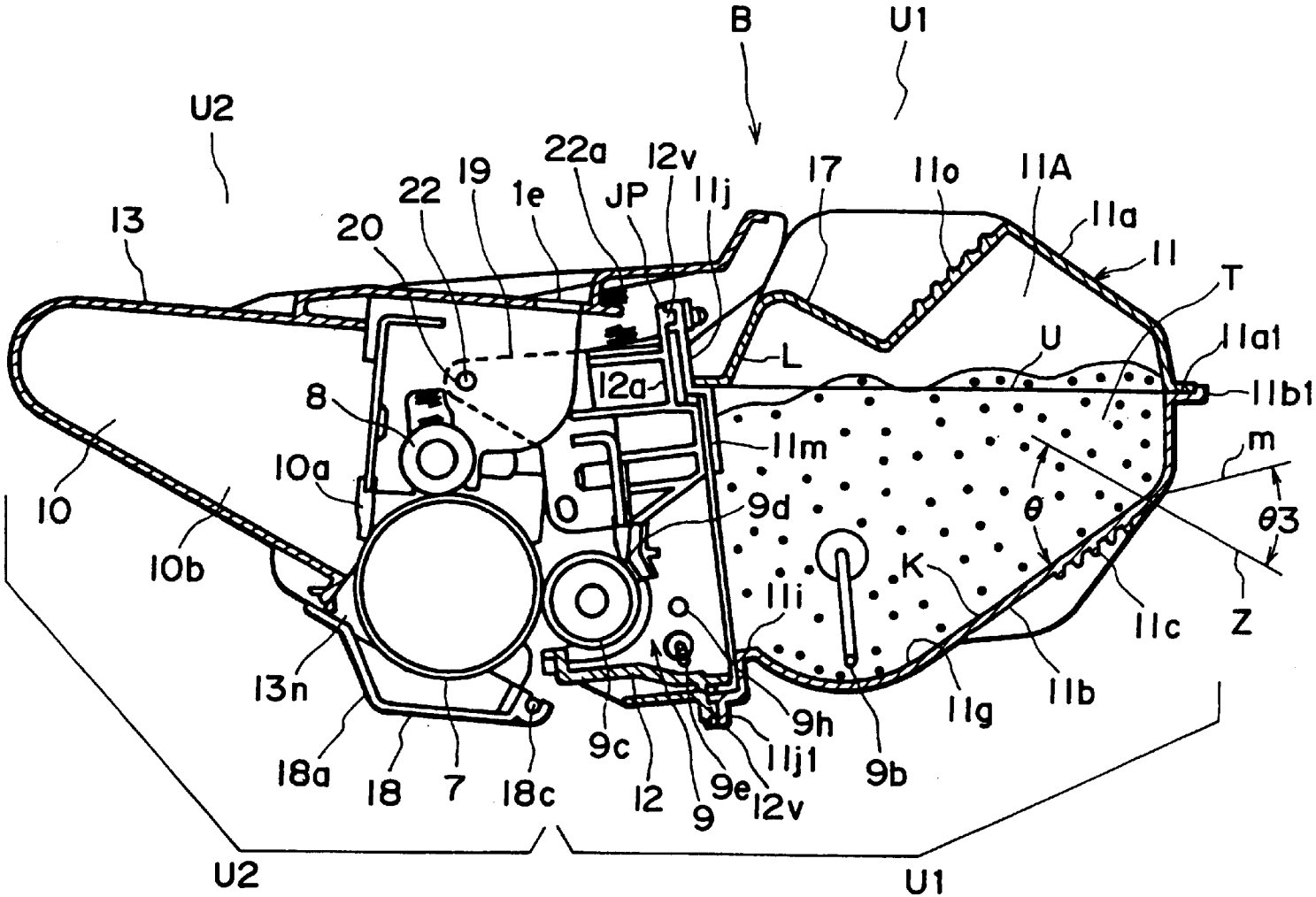
FIG. 3 is a longitudinal sectional view of a process cartridge.
Figure 4:
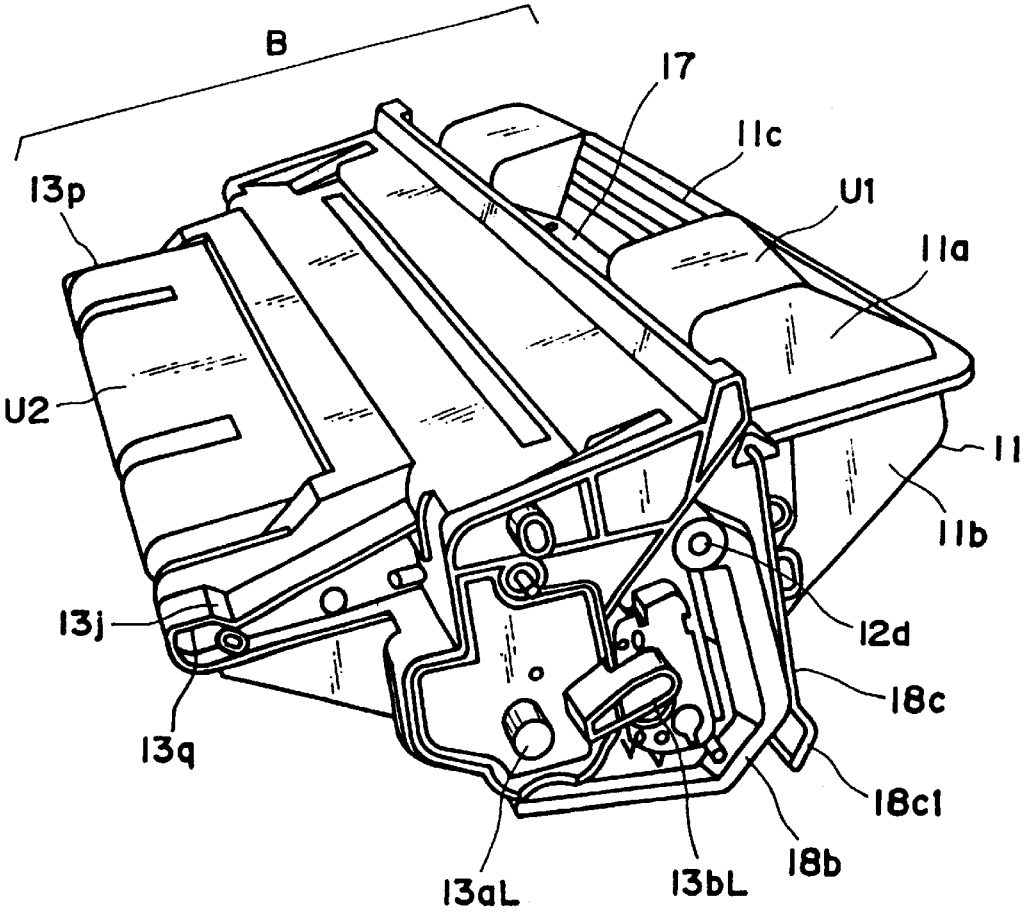
FIG. 4 is a perspective view of an outer appearance of a process cartridge.

FIGS. 3 and 4 illustrate a process cartridge according to an embodiment of the present invention.

FIG. 3 is a cross-sectional view of a process cartridge, and FIG. 4 is a perspective view of an outer appearance thereof.

In the following description, the "upper surface" of the process cartridge B is the surface that takes the top position, and the "lower surface" is the surface that takes the bottom position, when the process cartridge B is mounted to the main assembly 14 of the apparatus.

(Electrophotographic image forming apparatus A and process cartridge B)

Referring to FIGS. 1 and 2, a description will be provided as to the laser beam printer A as an exemplary electrophotographic image forming apparatus according to one embodiment of the present intention.

FIG. 3 is a cross-sectional view of a process cartridge B.

As shown in FIG. 1, the laser beam printer A forms an image on the recording material (recording paper, OHPsheet, textile or the like) through an electrophotographic image forming process.

In the apparatus, a toner image is formed on an electrophotographic photosensitive member (photosensitive drum) as an image bearing member in the form of a drum.

More particularly, the photosensitive drum is electrically charged by charging means, and it exposed to laser beam in accordance with the image information by optical means so that latent image is formed on the photosensitive drum in accordance with the image information.

The latent image is developed into a toner image by developing means

In synchronism with formation of the toner image, the recording material 2 placed in a sheet feeding cassette 3*a* is fed by a pick-up roller 3*b*, a pair of feeding rollers 3*c*,3*d* and a pair of registration rollers 3*a*.

Subsequently, the toner image formed on the photosensitive drum 7 contained in the process cartridge B, is transferred onto the recording material 2 by the application of a voltage to transferring means in the form of a transfer roller 4.

The recording material 2 now having the toner image is fed to fixing means 5 along a feeding guide 3*f*.

The fixing means 5 comprises a driving roller 5*c* and a fixing roller 5*b* containing a heater 5*a*.

The recording material 2 passing therethrough is supplied with heat and pressure so that toner image is fixed thereon.

The recording material 2 is then fed by a pair of discharging rollers 3*g*,3*h*,3*i* through a reverse path 3*j*, and is discharged to a discharging tray 6. Press The discharging tray is provided at the upper surface of the main assembly 14 of the image forming apparatus A.

By actuating the flapper 3*k* which is swingable, the recording material 2 can be discharged by the pair of discharging rollers 3*m* without passing through the reverse path 3*j*.

In this environment, the feeding means 3 is constituted by the pick-up roller 3*b*, the pair of feeding rollers 3*c*,3*d*, the pair of registration rollers 3*a*, the feeding guide 3*f*, the pair of discharging rollers 3*g*,3*h*,3*i* and the pair of discharging rollers 3*m*.

Of the other hand, as shown in FIGS. 3 and 4, the photosensitive drum 7 having a photosensitive layer is rotated, and the surface thereof is uniformly charged by voltage application to the charging means in the form of a charging roller 8.

Subsequently, the laser beam, which is modulated in accordance with the image information and supplied through an optical system 1, is projected onto the surface of the photosensitive drum 7 through an exposure opening 1*e* so that a latent image is formed.

The latent image is developed by developing means 9 with the toner.

The charging roller 8 is contacted to the surface of the photosensitive drum 7 to electrically charge the photosensitive drum 7.

The charging roller 8 is driven by the photosensitive drum 7.

The developing means 9 supplied the toner to a developing zone of the photosensitive drum 7 to develop the latent image formed on the photosensitive drum 7.

The optical system 1 comprises a laser diode 1*a*, a polygonal mirror 1*b*, a lens 1*c* and a reflection mirror 1*d*.

Here, the developing means 9 feeds the toner from the toner container 11A to the developing roller 9*c* by the rotation of a toner feeding member 9*b*.

When the developing roller 9*c* containing a fixed magnet is rotated, and a toner layer having triboelectric charge provided by a developing blade 9*d* is formed on the surface of the developing roller 9*c*, and the toner is supplied to the developing zone of the photosensitive drum 7.

The toner is transferred onto the photosensitive drum 7 in accordance with the latent image so that a visualized toner image is formed.

The developing blade 9*d* functions to regulate the amount of the toner applied on the peripheral surface of the developing roller 9*c*, and functions to apply the triboelectric charge to the toner.

Adjacent the developing roller 9*c*, there is provided a rotatable toner stirring member 9*e* for circulating the toner in the developer chamber.

The transfer roller 4 is supplied with a voltage having the polarity opposed from that of the toner image so that the toner image is transferred from the photosensitive drum 7 onto the recording material 2, and thereafter, the residual toner remaining on the photosensitive drum 7 is removed by the cleaning means 10.

The cleaning means 10 includes an elastic cleaning blade 10*a* conducted to the photosensitive drum 7, which scrapes the residual toner off the photosensitive drum 7, and the toner is collected into a residual toner container 10*b*.

The process cartridge B comprises a toner frame 11 having a toner container (toner accommodating portion) accommodating the toner, and a developing device frame 12 supporting the developing means 9 including the developing roller 9*c* or the like, these frames being coupled with each other.

Additionally, a cleaning frame 13 containing the cleaning means 10 such as a cleaning blade 10*a* or the like, and the charging roller 8, is coupled thereto.

The process cartridge B is detachably mountable to the main assembly 14 of the image forming apparatus by the operator.

The process cartridge B is provided with an exposure opening 1*e* for permitting projection of the image information light onto the photosensitive drum 7, and a transfer opening 13*n* for permitting the photosensitive drum 7 to face the recording material 2.

More particularly, the exposure opening 1*e* is formed in the cleaning frame 13, and the transfer opening 13*n* is formed between the developing device frame 12 and the cleaning frame 13.

A description will be provided as to the structure of a housing of the process cartridge B according to an embodiment of the present invention.

The process cartridge B of this embodiment comprises a toner frame 11 and a developing device frame 12, which are coupled with each other, and a cleaning frame 13 is rotatably coupled thereto. The housing contains the photosensitive drum 7, the charging roller 8, the developing means 9, and the cleaning means 10 or the like, and is formed into a cartridge.

The process partridge B is a detachably mounted to a cartridge mounting means provided in the main assembly 14 of the image forming apparatus.

(Structure of the housing of the process cartridge B)

The process cartridge B of this example is such that the housing is constituted by coupling the toner frame 11, the developing device frame 12 and the cleaning frame 13, as has been described hereinbefore, and the structure thereof will be described.

As shown in FIG. 3, a toner feeding member 9*b* is rotatably mounted to the toner frame 11.

The developing roller 9*c* and the developing blade 9*d* are mounted to the developing device frame 12, and adjacent the developing roller 9*c*, there is provided a rotatable stirring member 9*e* effective to circulate the toner in the developer chamber.

The developing device frame 12 is provided with an antenna rod 9*h* opposed to the developing roller 9*c* in the longitudinal direction as shown in FIG. 3, the antenna rod 9*h* being extended substantially parallel with the developing roller 9*c*.

Figure 5:
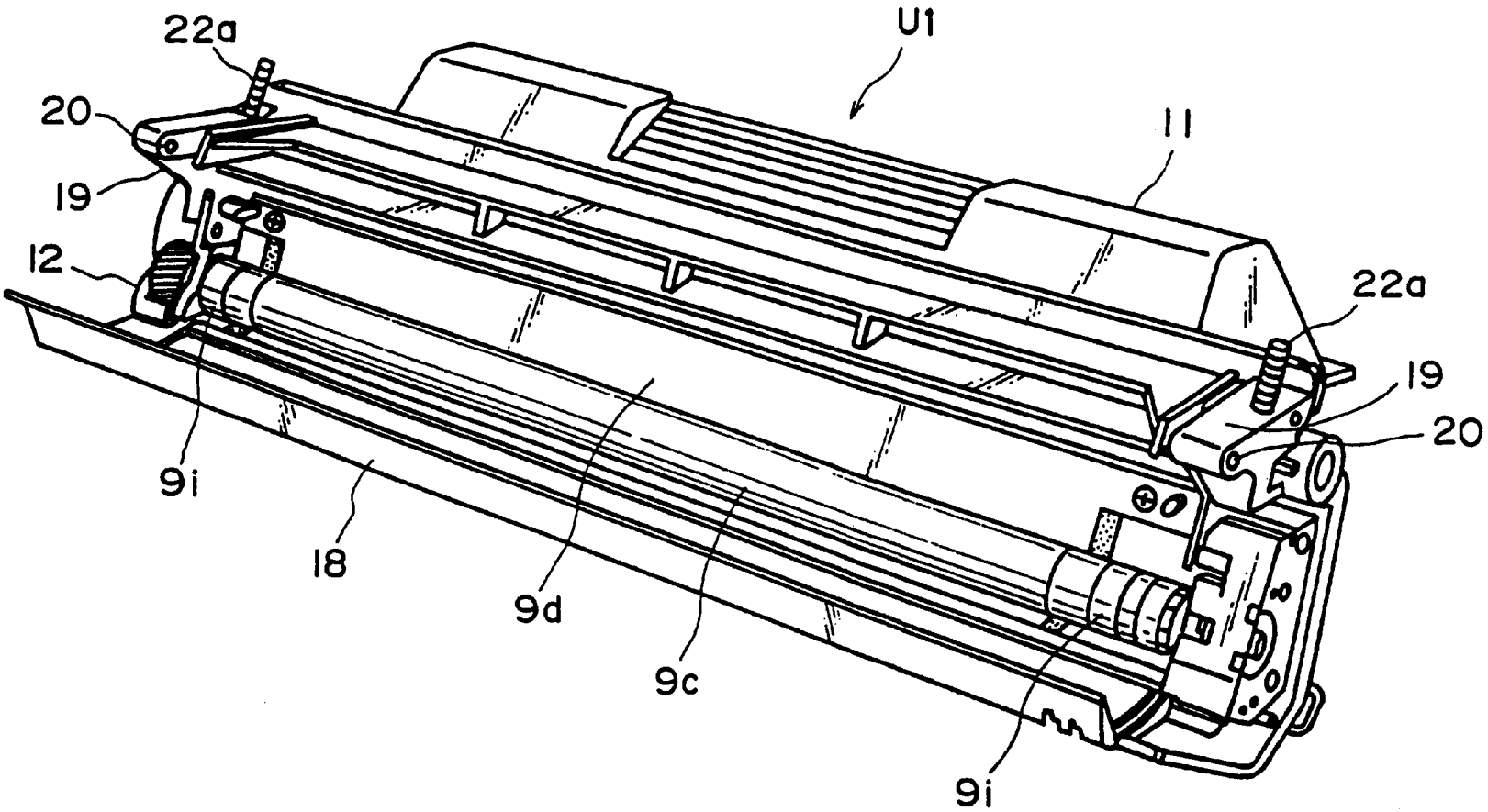
FIG. 5 is a perspective view of an outer appearance of a developing unit in a process cartridge.

The toner frame 11 and the developing device frame 12 are welded to each other (ultrasonic welding in this embodiment) to constitute an integral subunit as a developing unit U1 (FIG. 5).

The developing unit is provided with a drum shutter member 18 for protecting the photosensitive drum 7 from being exposed to light for a long time and from being touched by foreign matter when the process cartridge B is dismounted from the main assembly 14 of the image forming apparatus The drum shutter member 18, as shown in FIG. 4, is provided with a shutter cover 18*a* for opening and closing the transfer opening 13*n* shown in FIG. 3, and links 18*b*,18*c* for supporting the shutter cover 18*a*. Press One end of the link 18*c* is journaled to the toner frame 11 upstream of the shutter cover 18*a* with respect to the feeding direction of the recording material 2 at each of the opposite ends, as shown in FIG. 4.

The other end of each of the links 18*c* is journaled to the upstream portion of the shutter cover 18*a* with respect to the mounting direction of the process cartridge B The link 18*c* is made of metal wire, and the portion journaled to the shutter cover 18*a* is connected to the other between the opposite ends of the process cartridge B, and therefore, the left and right links 18*c* are integral with each other.

The link 18*b* is provided only at one side of the shutter cover 18*a*, and one end thereof is journaled to the shutter cover 18*a* at the downstream and, and the other end is journaled to a dowel 12*d* of the developing frame 12.

The link 18*b* is made of synthetic resin material.

The links 18*b*,18*c* have lengths different from each other, and it constitutes a quadric link with the shutter cover 18*a* and the frame constituted by the toner frame 11 and the developing device frame 12.

The laterally projected projected portion 18*cl* provided to each of the links 18*c* is abutted to a fixed member (unshown) provided adjacent to the cartridge mounting portion S (FIG. 1), and acts on the drum shutter member 18 when the process cartridge moves to open the shutter cover 18*a*.

The drum shutter member 18 including the shutter cover 18*a* and the links 18*b*,18*c* is such that shutter cover 18*a* covers the transfer opening 13*a* by an unshown coil spring locked to the developing device frame 12 at one end and engaged with the link 18*b* at the other end, the coil spring being provided in the dowel 12*d*.

As shown in FIG. 3 and FIG. 6, the cleansing frame 13 contains the photosensitive drum 7, the charging roller 8 and the cleaning means 10 to constitute a cleaning unit U2 (first frame), as shown in FIG. 6.

The developing unit U1 and the cleaning unit U2 are rotatably coupled with each other by a coupling member 22 in the form of a round pin.

More particularly, as shown in FIG. 3, a free end of an arm portion 19 formed at each longitudinal end of the developing device frame 12, is provided with a round rotation hole 20 extending parallel with the developing roller 9*c*.

Of the other hand, recesss (unshown) are provided at two positions at each longitudinal ends of the cleaning frame 13 for receiving the arm portions 19.

The arm portion 19 is inserted into the recess; the coupling member 22 is press-fitted into the mounting hole (unshown) of the cleaning frame 13 and is inserted into the rotation hole 20 out and end of the arm portion 19, and further is press-fitted into an inside hole of the cleaning frame 13, by which the developing unit U1 and the cleaning unit U2 are coupled with each other for rotation about the coupling member 22.

And this time, a compression coil spring 22*a* inserted into an unshown dowel standing from the base portion of the arm portion 19, is abutted to the upper wall of the recess of the cleaning frame 13, so that compression coil spring 22*a* urges the developing device frame 12 downwardly, so as to assuredly urge the developing roller 9*c* to the photosensitive drum 7.

Hubs shown in FIG. 5, a spacer roller 9*i* having a larger diameter than the developing roller 9*c* is provided at each of the longitudinal ends of the developing roller 9*c*, by which the roller 9*i* is pressed against the photosensitive drum 7 so that a predetermined clearance is maintained between the photosensitive drum 7 and the developing roller 9*c* (approx 300 microns). Press Therefore, the developing unit U1 and the cleaning unit U2 are rotatable relative to each other about the coupling member 22, and the positional relation between the peripheral surface of the photosensitive drum 7 and the peripheral surface of the developing roller 9*c* is maintained by the elastic force of the compression coil spring 22*a*.

Since the compression coil spring 22*a* is mounted to the developing device frame 12 at the base portion of the arm portion 19, the pressure of the compression coil spring 22*a* does not extend to the other portion, and therefore, there is no need of reinforcing the periphery of the spring seat as with the case when a member mounted to the developing device frame 12 is used as a spring seat, and can maintain the positional accuracy since the base portion of the arm portion 19has is of sufficient rigidity.

When the openable member 35 shown in FIG. 1 is opened about the hinge 35*a*, the cartridge mounting portion S is seen.

Each of the left and right inner wall of the cartridge mounting portion S is provided with a guiding member for guiding the process cartridge B, and the guiding members 13R, 13L (13*a*R, 13*a*L, 13*b*R, 13*b*L) provided at each of the left and right sides of the process cartridge B are inserted into the guiding member, and then, the drum shutter 18 is opened. As shown in FIG. 1, the exposure of the photosensitive drum 7 to the light from the optical means 1 is permitted, and the photosensitive drum 7 is positioned so as to be faced to the transfer roller 4 for transferring the image formed on the photosensitive drum 7 onto the recording material 2.

However, the guiding member 13R (13*a* R, 13*b*R) is provided on a side of the process cartridge B longitudinally opposite from the guiding member 13L (13*a*L, 13*b*L), and therefore, this is not seen in the Figure.

The orientation of the process cartridge B is determined by the regulating abutments 13*j* provided on the left-hand end 13*q* and the right-hand end 13*b* on the top side of the cleaning frame 13 abutting unshown fixed members in the main assembly 14 of the apparatus.

(Toner frame)

Referring to FIG. 3, a description will be provided as to a toner frame.

As shown in FIG. 3, the toner frame 11 comprises an upper frame 11*a* and a lower frame 11*b* (two parts structure).

The upper frame 11*a* expands upwardly so as to occupy the right hand side space of the optical system 1 of the main assembly 14 of the image forming apparatus, as shown in FIG. 1, and the toner accommodating capacity of the process cartridge B is increased.

As shown in FIGS. 3, 4, a recess 17 (concave as seen from the outside) is provided in the longitudinally central part of the upper frame 11*a* to provide a grip function.

Then, the operator holds the process cartridge at the recess 17 of the upper frame 11*a* and the bottom side of the lower frame 11*b*.

The ribs 11*c* extending in the longitudinal direciton and provided on the bottom side of the lower frame 11*b* and on one side of the recess 17 function to prevent slippage.

As shown in FIG. 3, the frame 11*a*1 of the upper frame 11*a* is fitted into the rimmed flange 11*b*1 of the lower frame

11*b*, and the welding surfaces are contacted. Then, the welded ribs are melted to integrate the frames 11*a*, 11*b* by welding.

The connecting method may be not limted to the ultrasonic welding, but may be usual welding, forced vibration, bonding or the like.

When the frames 11*a*,11*b* are welded by ultrasonic welding, the frames 11*a*,11*b* are supported by the flange 11*b*1 as described above, and in addition, there is provided a stepped portion 11*m* on substantially the same surface of the flange 11*b*1 at an upper outside position of the opening 11*f*.

Prior to connecting the frames 11*a*, 11*b*, the toner feeding member 9*b* is assembled into the lower frame 11*b*.

A cylindrical or generally rectangular triangle toner filling opening 11*d* (11*da*, 11*db*) (FIGS. 6,7) is provided to permit supply of the toner, at one longitudinal end of the lower frame 11*b*.

The edge of the toner filling opening 11*db* includes a side extending along a connection line between the upper and lower toner frames 11*a*,11*b*, a side extending substantially vertically perpendicularly to said side, and a hypotenuse side extending along a bottom side of the lower frame 11*b*.

By this, the toner filling opening 11*db* is given a maximum size.

As shown in FIG. 3, an opening 11*i* of a toner frame 11 is provided extending in the longitudinal direction of the toner frame 11 to permit supply of the toner from the toner frame 11 to the developing device frame 12, and a toner frame 11 which will be described hereinafter is welded to close the opening 11*i*.

Thereafter, the toner is filled through the toner filling opening 11*d*, and the toner filling opening 11*d* is plugged by a toner cap 11*f* (11*fa*, 11*fb*) as shown in FIGS. 6,7, so that the toner unit is completed.

The toner cap 11*f* is made of polyethylene, polypropylene or the like, and it is heated, and then is press-fitted into the toner filling opening 11*d* formed in the toner frame 11.

The toner unit is welded with the developing device frame 12 by ultrasonic welding so that the developing unit U1 is completed.

However, the connecting method is not limted to the ultrasonic welding, and bonding, snap fit using elastic force, or the like is usable.

As shown in FIG. 3, the lower frame 11*b* of the toner frame 11 is provided with an inclined surface K with sufficient inclination angle "Greek theta" to permit free fall of the toner when the toner is consumed, and more particularly, the angle between a horizontal line Z and the inclined surface K when the process cartridge B is mounted to the main assembly 14 placed horizontally, is preferably approximately 65 degrees.

The lower frame 11*b* is provided with a recessed portion at the lower portion to escape from the rotational region of the toner feeding member 9*b*.

The rotation diameter of the toner feeding member 9*b* is approximately 37 mm.

It will suffice if the 11*g* is recessed by approximately 0 mm–10 mm from an extension line of the inclined surface K.

This is because if the edge portion of the recessed portion 11*g* is projected beyond the inclined surface K, the free fall of the toner will be blocked thereby, so that toner existing between the recessed portion 11*g* and the inclined surface K is not fed into the developing device frame 12, and some toner will remain unused. This is avoided by the above-described structure to accomplish assured feeding of the toner from the toner frame 11.

By the provision of the recessed or concave shape portion 11*g* to escape the toner feeding member 9*b* in the bottom surface of the toner frame 11, the stable toner feeding property can be provided without a cost rise.

As shown in FIG. 3, the connecting portion of the toner frame 11 relative to the developing device frame 12 is provided with an opening 11*i* for feeding the toner to the developing device frame 12 from toner frame 11.

Around the opening 11*i*, as shown in FIGS. 6, 7, a recessed surface 11*k* is provided.

Grooves 11*n* are provided in parallel at the opposite edges in the longitudinal directions of the upper and lower flanges 11*j*,11*jl* of the recessed surfaces 11*k*.

The upper part flange 11*j* of the recessed surface 11*k* has a gate shape, and the lower flange 11*jl* extends in a transverse direction relative to the recessed surface 11*k*.

The flange 11*j* of the opening 11*i* may be in the form of a door frame in the same plane.

As shown in FIG. 3, the surface of the developing device frame 12 opposed to the toner frame 11 is one flat surface, and upper and lower and longitudinally opposite ends of the flat surface are provided with a door-frame-like flange 12*e* parallel with the flat surface are provided at a retracted position in a closed shape, and a rib 12*v* for engagement with an elongated groove 11*n* of the toner frame 11 is extended longitudinally along the edge of the flange 12*e*.

The rib 12*v* has a top surface provided with a triangular projection to be used for ultrasonic welding.

The toner frame 11 containing various parts and the developing device frame 12 containing the various parts are engaged by engagement between the groove 11*n* of the toner frame 11 and the rib of the developing device frame 12 and then are welded by ultrasonic welding along the longitudinal direction.

As shown in FIGS. 6, 7, an easily torn cover film 51 is stuck on the recessed surface 11*k*, extending in the longitudinal direction so as to close the opening 11*i* of the toner frame 11.

The cover film 51 is stuck on the toner frame 11 along the four edges of the opening 11*i* on the recssed surface 11*k*.

A tear tape 52 is welded to the cover film 51 and is effective to tear the cover film 51 to open or unseal the opening 11*i*.

The tear tape 52 is folded back at one longitudinal end 52*b* of the opening 11*i* to extend to the other end where it is provided with an elastic sealing material (not shown), such as felt, which is bonded to the longitudinal end portion of the flat surface opposed to the toner frame 11 of the developing device frame 12, and a grip for permitting an operator to pull out the tear tape 52.

The grip member 11*t* is integrally molded with the toner frame 11, and the connection part relative to the toner frame 11 is thinned particularly to permit easy separation, and the end of the tear tape 52 is stuck to the grip member 11*t*.

In this state, the toner frame 11 and the developing device frame 12 are pressed to each other, and ultrasonic vibration is imparted between the rib 12*v* and the elongated groove 11*n* for the triangular projection to melt by frictional heat to weld with the bottom of the elongated groove 11*n*.

By doing so, a space is provided which is defined by closely contacted portions between the recssed surface 11*k* of the toner frame 11 and the surface of the developing device frame 12 opposed thereto.

The cover film 51 and the tear tape 52 are accommodated in the space.

In order to feed the toner from the toner frame 11 into the developing device frame 12, the base portion of the grip member 11*t* is separated from the toner frame 11, or is torn, and then, the operator pulls out the grip member 11*t*, by which the cover film 51 is torn, and the opening 11*i* is unsealed and opened to permit the toner move from the toner frame 11 into the developing device frame 12.

Here, FIG. 3 is a cross-sectional view of the toner frame 11 employed in this embodiment.

In FIG. 3, the connecting surface JP between the toner frame 11 and the developing device frame 12 extends substantially in a vertical direction.

A detailed description will be provided as to the toner frame 11 used in this embodiment.

In order to efficiently let the one component toner in the toner container 11A fall toward the opening 11*i* direction, there are provided two inclined surfaces K,L.

The inclined surfaces K,L are extended over the entire length of the toner frame 11.

The inclined surface L is provided at an upper part portion of the opening 11*i*, and the inclined surface K is provided at a rear side of the opening 11*i*.

The inclined surface L is provided in the upper frame 11*a*, and the inclined surface K is provided in the lower frame 11*b*.

The inclined surface L extends vertially or faces generally downward when the process cartridge B is mounted to the main assembly 14 of the apparatus.

The angle formed between the horizontal line z and the line m perpendicular to the connecting surface JP between the toner frame 11 and the developing device frame 12 is approximately 20 degrees–40 degrees.

In other words, in this embodiment, the connection of the upper frame 11*a* and the lower frame 11*b* is such that the configuration of the upper frame 11*a* is determined so that the lower frame 11*b* is set at the above-described angle.

Therefore, according to this embodiment, the toner container 11A accommodating the toner can supply the toner toward the opening 11*i* direction efficiently.

(Toner cap)

(Embodiment 1)

A description will be provided as to a toner cap 11*fa* according to an embodiment thereof.

The cap of this embodiment is used with a toner filling opening 11*da* in the form of a circular hole as shown in FIG. 6.

Figure 9:
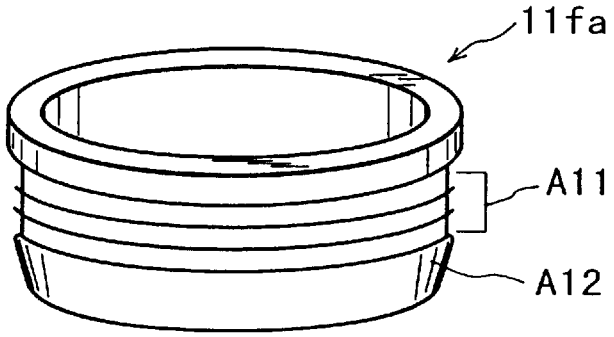
FIG. 9 is a perspective view of a circular toner cap (projected configuration) wherein the bottom surface of the cap is flat, according to Embodiment 1 of the present invention.
Figure 11:
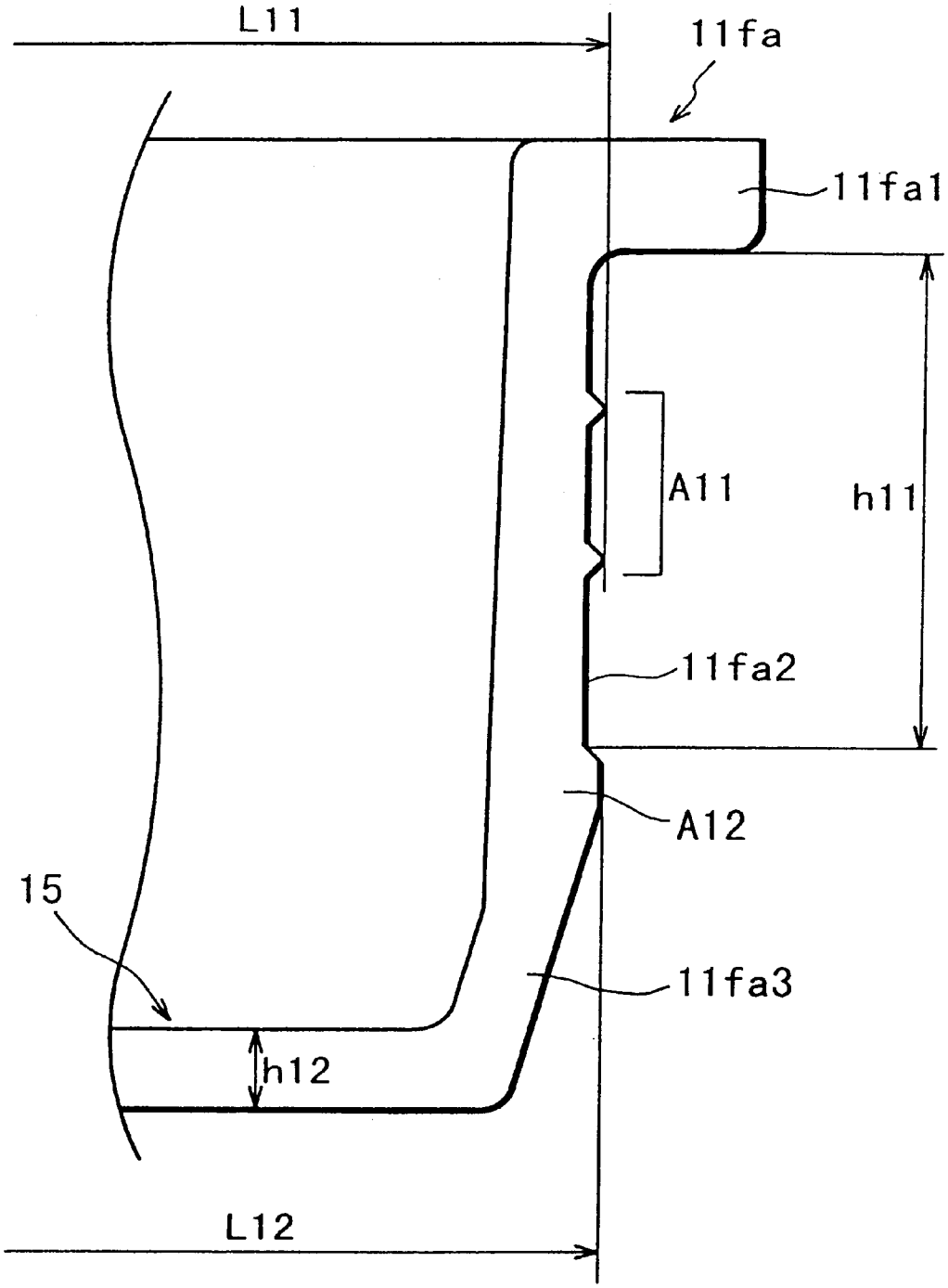
FIG. 11 is a longitudinal sectional view of a toner cap having a circular projected configuration according to this Embodiment 1.

FIGS. 9,11 are a perspective view and a sectional view of a toner cap 11*fa* according to an embodiment of the present invention.

Figure 14:
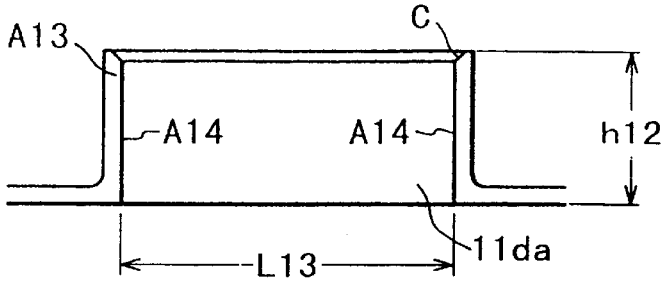
FIG. 14 is a partial longitudinal sectional view of a toner filling opening of a toner container according to this Embodiment 1 of the present invention.

FIG. 14 is a sectional view of the toner filling opening 11*da* of the toner container according to an embodiment of the present invention.

In Embodiment 1, the projected configuration of the toner filling opening 11*da* and that of the toner cap 11*fa* are both circular.

As shown in FIG. 11, the toner cap 11*fa* has a flange 11*fa*1 having a diameter larger than the engaging portion 11*fa*2, and it has a retainer A12 portion and an introducing portion 11*fa*3 adjacent the engaging portion 11*f*2, at a position across the engaging portion 11*f*2 from the flange 11*fa*1.

The toner cap 11*fa* further includes a rib A11 (seal portion) in the engaging portion 11*fa*2.

Correspondingly, the toner filling opening 11*da*, as shown in FIG. 14, has an inner wall A14 (seal portion), wherein a length h12 of the inner wall A14 having the engaging portion for engagement with the engaging portion 11*fa*2 of the cap 11*fa* is shorter than the length h11 of the engaging portion from the flange 11*fa*1 of the toner cap 11*fa* to the retaining portion or retainer A12 so that retainer A12 of the toner cap 11*fa* penetrates the inner wall of the toner filling opening A14 when the toner cap 11*fa* plugs the toner filling opening 11*da*.

FIG. 6 show the engaging state.

The rib A11 of the engaging portion 11*fa*2 of the toner cap 11*fa* is in the form of a rib enclosing the cylindrical engaging portion 11*fa*2.

The rib A11 is a two-lead rib.

The introducing portion 11*fa*3 is conical in shape.

However, the configuration of the generating line may be convex outward, for example, if it converges toward the tip end.

The degree or dimension of "bite" of the rib A11 is defined, using a difference between the diameter L11 of the rib A11 shown in FIG. 11 and a diameter L13 of the toner filling opening 11*da* shown in FIG. 14.

The bite of the rib A11 is (L11–L13)/2.

The actual degree of press-fitting is (L11–L13).

The bite, defined above, of the rib A11 is preferably not less than 0.05 mm and not more than 0.2 mm, and further preferably not less than 0.05 mm and not more than 0.15 mm, and in this embodiment it is 0.1 mm.

When this is expressed in the degree of the press-fitting, it is preferably not less than 0.1 mm and not more than 0.4 mm in the direction of diameter, and further preferably not less than 0.1 mm and not more than 0.3 mm, and in this embodiment it is 0.2 mm.

The dimension L12 of the retainer A12 is larger than the diameter L13 of the inner wall of the toner filling opening A14 by 0.5 mm in this embodiment to assure retention of the cap therein.

The material of the toner cap 11*f* (the circular toner cap 11*fa* or 11*fc* and the toner cap 11*fb*) is preferably as follows when the press-fitting engagement is used, in view of the sealing stability, and prevention of milkiness (creep phenomenon) upon the capping (engaging the toner cap into the toner filling opening).

High density polyethylene (HDPE) or polypropylene has bending elastic modulus (JIS-K7203), and low density polyethylene (LDPE) or high density polyethylene (HDPE) has Olsen rigidity (JIS-K7016), and the bending elastic modulus of the toner cap 11*fa*, 11*fb*, 11*fc* (11*f*) is preferably equivalent to or lower than that of the main assembly 11, 11*a*, 11*b* (11)

Therefore, the toner cap 11*f* preferably has a bending elastic modulus of 690–2160 Mpa and an Olsen rigidity of 88–1320 Mpa, and further preferably has a bending elastic modulus of 1000 Mpa–2160 Mpa and an Olsen rigidity of 130–980 Mpa, and even further preferably has an Olsen rigidity of approx 155 Mpa, and in this embodiment, the Olsen rigidity is 157 Mpa.

The material of the main assembly 11 of the toner container may be for example shock-resistant polystyrene (HIPS), BS, polyphenylene ether (PPE) or polyphenylene oxide (PPO), the bending elastic modulus of the main body 11 of the toner container is preferably not less than 1900 Mpa and not more than 11770 Mpa, and further preferably 2000–3000 Mpa, and even further preferably approximately 2500 Mpa, in this embodiment, it is 2400 Mpa.

On the other hand, the toner filling opening 11*da* of the main body 11 of the toner container shown in FIG. 6 is provided with a cylindrical portion A13 of the toner filling opening 11*d* as shown in FIG. 14.

The toner filling opening 11*da* is integrally molded with the toner container 11.

To permit smooth capping, the cylindrical portion A13 is provided with a C-beveling at the edge of the inner wall A14 (upper part in FIG. 14).

The outer diameter L12 of the retainer A12 provided at the lower portion of the toner cap 11*fa* is made larger than the inner diameter L13 of the toner filling opening 11*da*.

Figure 16:
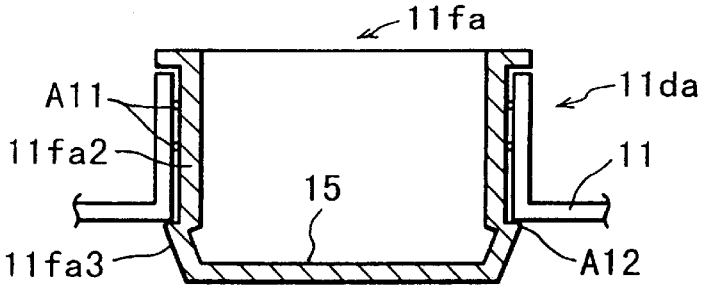
FIG. 16 is a longitudinal sectional view illustrating engagement of a toner cap according to this Embodiment 1 of the present invention.

When the cap is engaged, the retainer A12 penetrates the toner filling opening 11*da* to a position indicated in FIG. 16, thus preventing easy removal thereof.

The major dimensions of the toner cap 11*fa* and the toner filling opening 11*da* are as follows:

Toner cap, rib A11 outer diameter (L11): 34.2 mm

Toner cap, retainer A12 outer diameter (L12): 34.5 mm

Toner cap, engaging portion length (h11): 15.5 mm

Filling port of the container, inner diameter (L13):34.0 mm

Filling port of the container, inner diameter, length (h12): 15.0 mm

The major dimensions of the toner cap 11*fc* shown in FIG. 8 are the same as the above.

Embodimnt 2)

A toner cap 11*fb* according to Embodiment 2 will be described.

Figure 10:
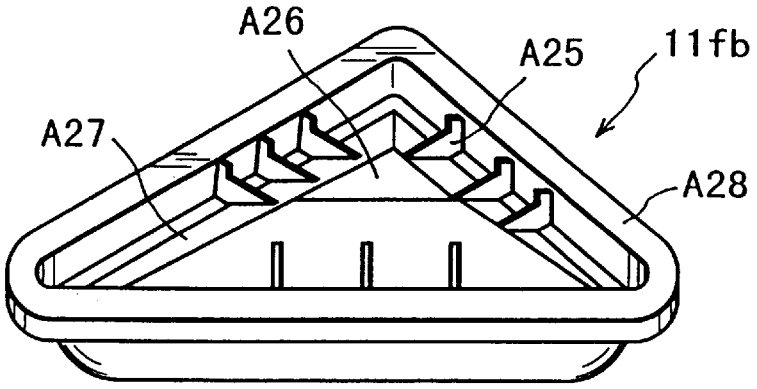
FIG. 10 is a perspective view of a substantially triangular shape toner cap (projected configuration) according to Embodiment 2 of the present invention.
Figure 12:
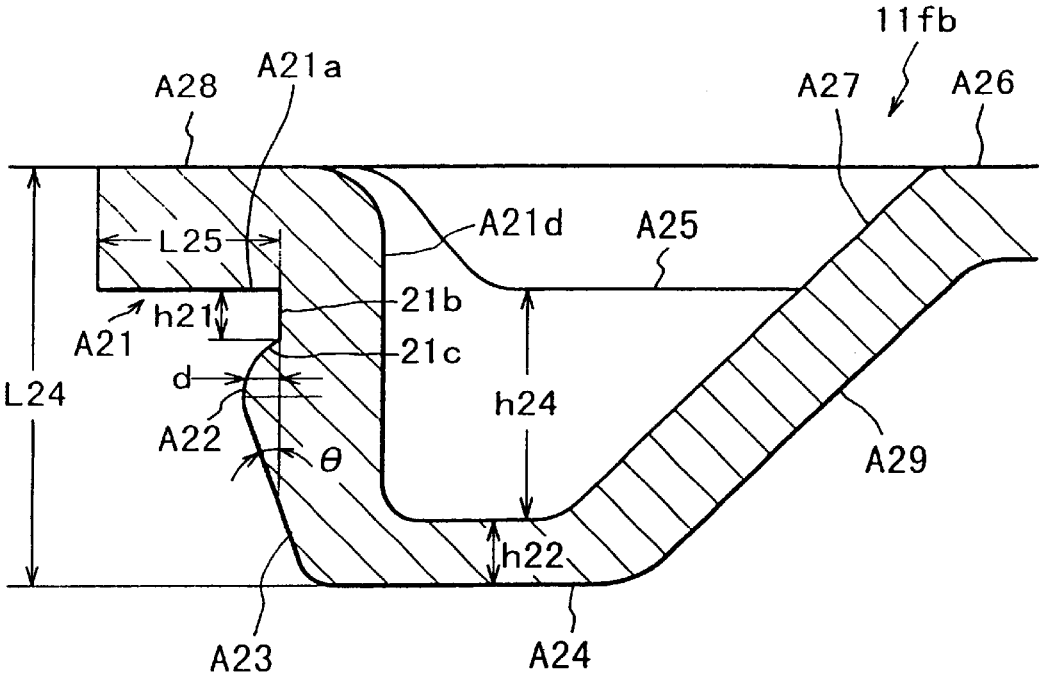
FIG. 12 is a longitudinal sectional view of a substantially triangular shape toner cap (projected configuration) according to this Embodiment 2.
Figure 13:
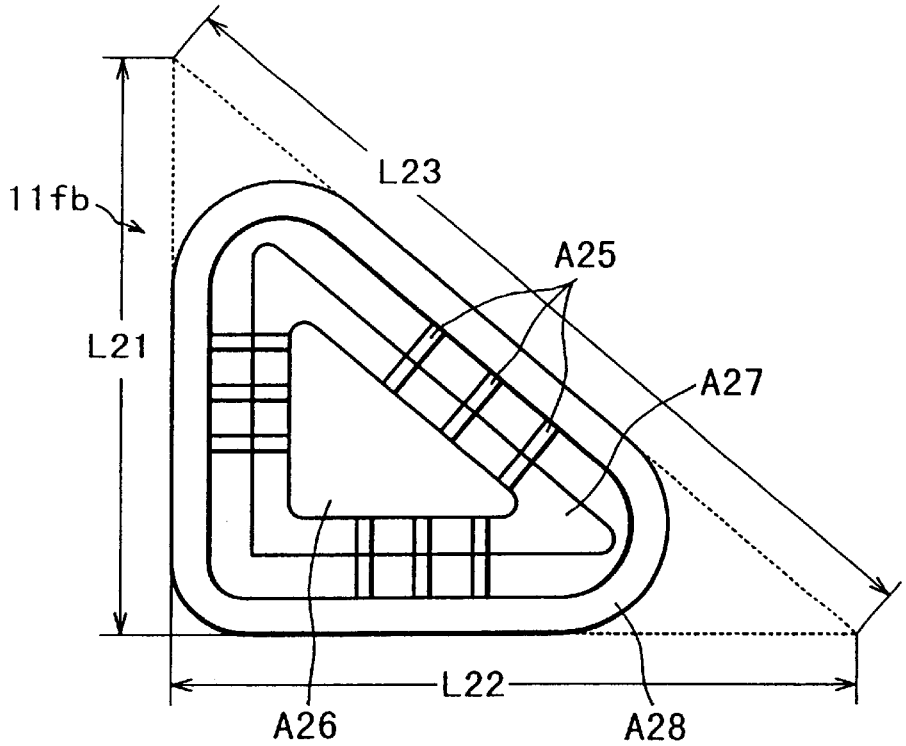
FIG. 13 is a top plan view of a substantially triangular shape toner cap (projected configuration) according to this Embodiment 2 of the present invention.

FIGS. 10, 12 and 13 are a perspective view, a sectional view and a top plan view of the toner cap 11*fb* according to Embodiment 2.

Figure 15:
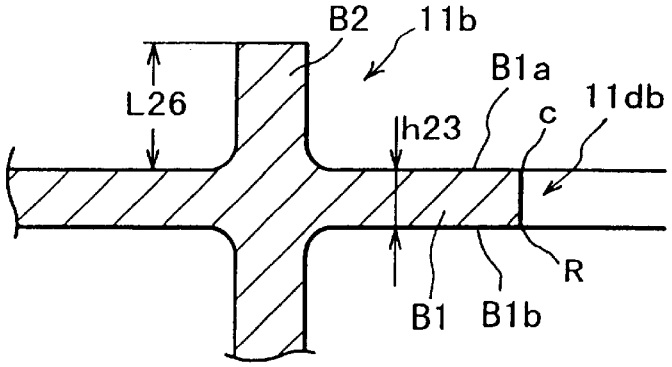
FIG. 15 is a partial longitudinal sectional view of a toner filling opening of a toner container according to this Embodiment 2 of the present invention.

FIG. 15 is a partially sectional view of a filling port 11*db* of a toner container according to Embodiment 2.

In Embodiment 2, the projected configurations of the toner cap 11*fb* and the filling port 11*db* are substantially rectangular triangle.

The toner cap 11*fb* comprises a groove portion A21 (seal portion), a notch A22, a notched inclined surface A23, a cap, a bottom portion A24, a reinforcing rib A25, a cap knob portion A26, an outer inclined surface portion A27, a cap flange portion A28 and inner inclined surface portion A29.

The groove portion A21 comprises an upper portion A21*a*, a bottom portion A21*b* and a lower portion A21*c*.

The width h21 of the bottom portion A21*b* of the groove is determined so that edge portion B1 of the toner filling opening 11*db* formed at one end of the main assembly 11*b* of the toner container 11A bites in the groove portion A21 of the toner cap 11*fb*, by which the toner cap 11*fb* is sealed.

The degree of "bite" d of the notch A22 (FIG. 12) is preferably 0.4–1.4 mm, and further preferably 0.45–0.9 mm, and even further preferably 0.5–0.8 mm in consideration of the cap bite which will be described hereinafter, and in this embodiment it is 0.7 mm.

The notched inclined surface A23 is provided for the purpose of smooth insertion of the toner cap 11*fb* upon capping, and the notch angle "Greek theta" is preferably not less than 30 degrees and less than 90 degrees, and further preferably not less than 45 degrees and less than 90 degrees, and even further preferably not less than 60 degrees and less than 80 degrees, and in this embodiment, it is 65 degrees.

The thickness of the bottom portion A24 of the cap is preferably less than the basic thickness of the toner cap 11*fb*, and in this embodiment, the basic thickness of the toner cap 11*fb* is 1.5 mm, and the thickness of the bottom portion A24 of the cap h22 is 1.0 mm.

This is in order to minimize the deformation of the toner cap 11*fb* and the milkiness (creep phenomenon) tending to occur at the back side A21*d* of the groove portion A21.

In order to prevent deterioration of the sealing performance attributable to deformation of the linear portion of each side of the rectangular triangle after the capping with the toner cap 11*fb*, at least two (three in this embodiment) reinforcing ribs A25 are provided in each direction, and the reinforcing ribs A25 are extended ourwardly from a cap knob A26 provided at the center of the toner cap 11*fb*.

The height h24 of the reinforcing rib A25 is preferably not less than 1 mm and not more than 3 mm, and further preferably not less than 1.5 mm and not more than 2.5 mm, and even further preferably 1.8–2.2 mm, and in this embodiment, it is 2 mm.

If the height h24 of the toner cap 11*fb* is less than 1.0 mm, the function of the reinforcing rib A25 is deteriorated, and therefore, the sealing performance is lower, and if it exceeds 3 mm, a so-called sink mark is produced at a back side during the molding with the result that the required dimension is not provided.

The outer inclined surface portion A27 and the inner inclined surface portion A29 are provided in order to minimize the deformation of the toner cap 11*fb* upon the capping and the milkiness (creep phenomenon) tending to occur at the back side A21*d* of the groove portion A21.

Figure 17:
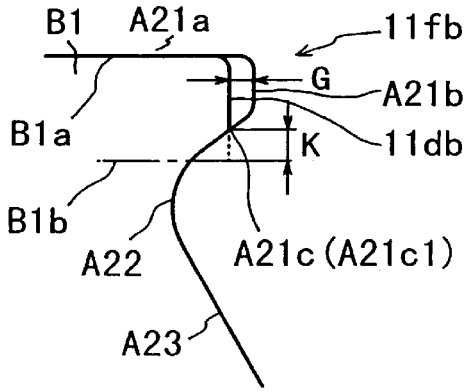
FIG. 17 is a longitudinal sectional view of an engaging portion of a toner cap according to this Embodiment 2 of the present invention.
Figure 18:
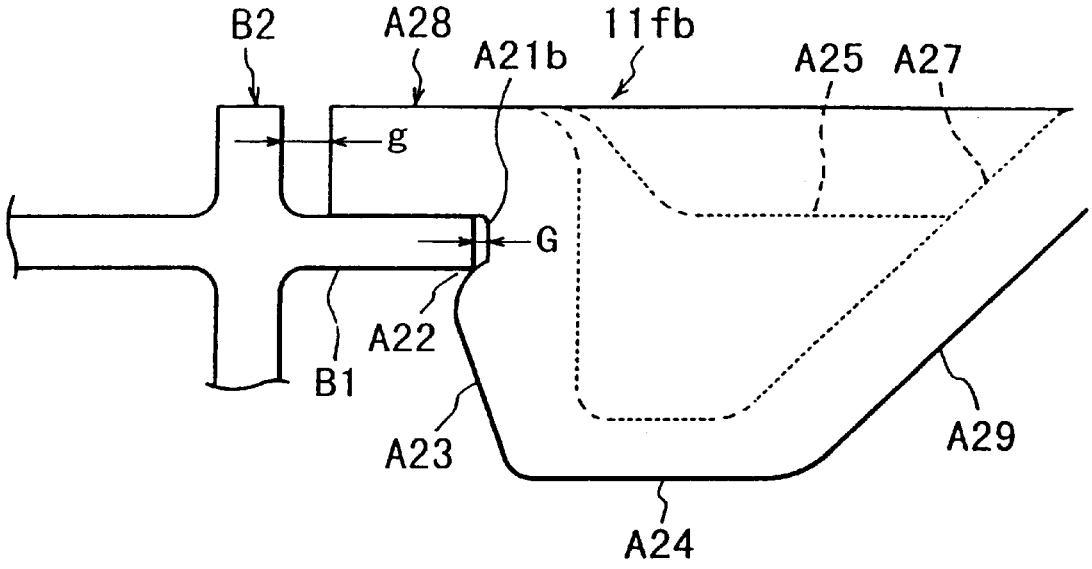
FIG. 18 is a longitudinal sectional view illustrating engagement of a toner cap according to this Embodiment 2 of the present invention.

FIGS. 17,18 show the state of engagement between the toner cap 11*fb* and the toner filling opening 11*db*, and as shown in Figure, when the toner cap 11*fb* is engaged with the toner filling opening 11*db*, the deformation occues due to the biting dimensions, and the milkiness (creep phenomenon) tends to occur more if the deformation is larger.

In the case that toner cap 11*fb* bites into the inner wall of the opening, the material of the toner cap 11*fb* are limited in terms of the stability in the sealing and the prevention of the milkiness (creep phenomenon) upon engagement with the toner filling opening 11*db*. The foregoing embodiment applies to this embodiment in these respect, including the hardness, elastic modulus, strength of the cap, and the material of the main body of the container.

More particularly, the material of the toner cap 11*fb* is low density polyethylene (LDPE), high density polyethylene (HDPE), polypropylene (PP), and the material of the main body of the container is for example shock-resistant polystyrene (HIPS), ABS, polyphenylene ether (PPE), polyphenylene oxide (PPO), which may be injection molded.

On the other hand, the toner filling opening 11*db* of the main body 11*b* of the container is provided with an edge portion B1 (engaging portion relative to the toner filling opening 11*db*) and a cap guide B2 (insertion guide upon capping) as shown in FIG. 15.

The toner filling opening 11*db* is integrally molded with the main body 11*b* of the container.

The edge portion B1 includes an upper portion B1a provided with a C surface taking for permitting smooth insertion and a lower portion B1b rounded by not more than 0.3 mm.

The lower portion A21c of the groove of the toner cap 11*fb* is provided with a linear inclined portion A21c1 as shown in FIG. 17, and the lower portion B1b of the edge bites into the inclined portion A21c1 so that sealing performance is significantly improved.

The rounding at the lower portion B1b of the edge in this embodiment is R0.3 mm.

In FIG. 17, K is the degree of bits of the toner cap 11*fb* and is preferably not less than 0.2 mm and not more than 1.4 mm, and further preferably is 0.7 mm approximately, and in this embodiment it is 0.5 mm.

By the biting of the toner cap 11*fb*, the sealing performance of the toner cap 11*fb* is provided. In order to avoid deterioration of the sealing performance due to contact between the toner cap 11*fb* and the toner filling opening 11*db* at another portion, a gap G is provided between the edge portion B1 and the bottom portion A21b of the groove upon the toner cap 11*fb* engagement.

The G is preferably not less than 0.1 mm and less than 0.2 mm, and in this embodiment, it is 0.2 mm.

The gap between the cap guide B2 and the toner cap 11*fb* is preferably not less than 0.2 mm and less than 2 mm, and in this embodiment, it is 0.3 mm.

The major dimensions of the toner cap 11*fb* and the filling port 11*db* are as follows (FIGS. 12,13,15):

First toner cap outer dimension (L21): 39.54 mm

Second toner cap outer dimension (L22): 50.06 mm

Third toner cap outer dimension (L23): 63.78 mm

Toner cap height (L24): 4.5 mm

Width of flange of the toner cap (L25): 2.6 mm

Height of toner cap guide: 2.8 mm

A description will be provided as to the developing unit U1, referring to FIG. 5, FIG. 6 and FIG. 7.

FIG. 5 is a perspective view of an outer appearance wherein the developing unit U1 and the cleaning unit U2 of the process cartridge B are separated, and FIGS. 6 and 7 all perspective views of an outer appearance of a toner frame 11 constituting the developing unit U1.

In FIG. 6, the main assembly 11*b* of the toner container is provided with a toner filling opening 11*da* in the form of circular hole according to Embodiment 1 and a toner cap 11*fa* having a circular projected configuration.

FIG. 7 shows the example in which the triangular shape toner filling opening 11*db* and the triangular shape toner cap 11*fb* according to the above-described Embodiment 2, are engaged.

In the case of the main body 11*b* of the toner container having the circular filling port 11*da*b, the toner cap 11*fc* having a cross-shaped projection C1 shown in FIG. 8 can be used.

Such a toner cap 11*fc* will be described hereinafter.

The toner frame 11 is provided with toner filling openings 11*da*, 11*db* for permitting filling of the toner T, and the toner filling openings are sealed by the toner cap 11*fa* or 11*fb* or 11*fc*.

(Method of removing the toner cap)

FIG. 19 to FIG. 27 show toner cap dismounting steps.

The toner frame 11 is not shown in all of these figures for simplicity.

The method of mounting the toner cap 11*f* is the same.

(1) disassembling of the circular toner cap 11*fa*

Figure 19:
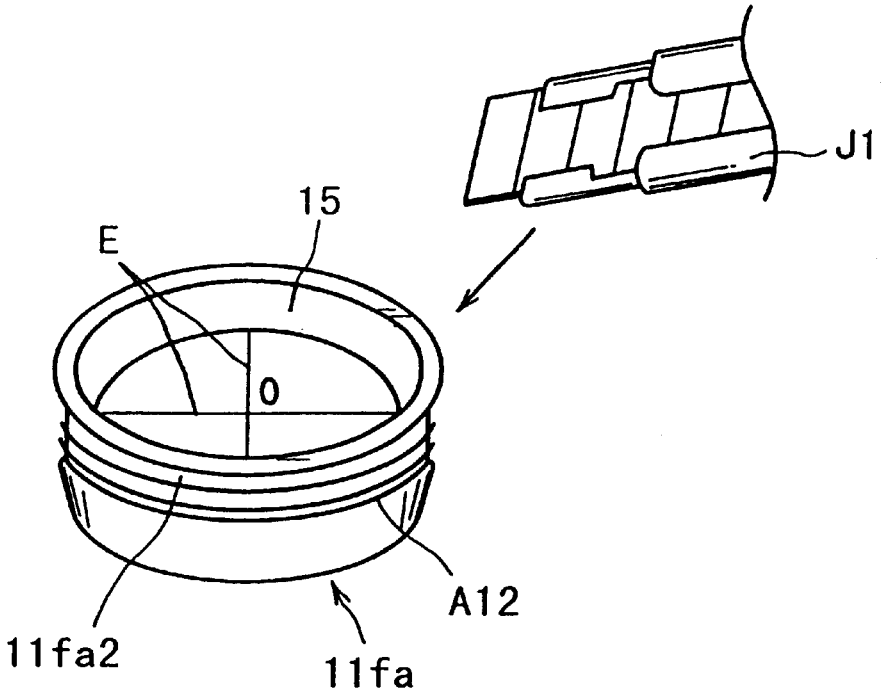
FIG. 19 is a perspective view illustrating an example of a notch of a toner cap according to Embodiment 1 of the present invention.

As shown in FIG. 19, the bottom 15 the toner cap 11*fa* is cut along two crossing lines within a cutter J1 (crossing point is indicated by O).

Figure 20:
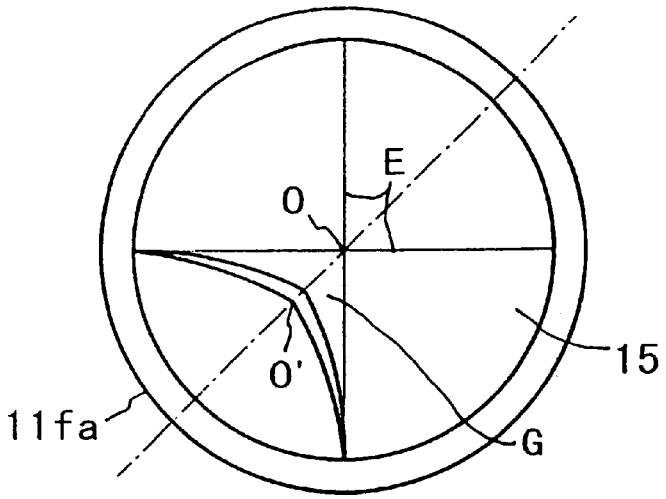
FIG. 20 is a perspective view illustrating another example of a notch of a toner cap according to Embodiment 1 of the present invention.

As shown in FIG. 20, the four sector sediments of the circle of the bottom of the toner cap 11*fa* are erected by a tool such as ice pick, so that free end O' is raised from the bottom.

The rigidity of the retainer A12 portion of the toner cap 11*fa* decreases because of formation of an opening G below the free end O', and therefore, the rigidity of the rigidity also decreases.

The rigidity of the portion of the retainer A12 particularly decreases.

As shown in FIG. 24, (*a*), the free end O' is pinched by a pinching tool J2 such as a small pench, and the tool J2 is moved in the arrow C direction, and then, as shown in FIG. 24, (*b*), the diameter of the retainer A12 decreases, and the bottom 15 of the toner cap expands outwardly from the toner cap 11*fa*.

Then, the tool J2 is further raised, by which the toner cap 11*fa* is removed from the toner filling opening 11*da*.

(2) disassembling of the circular toner cap 11*fc* provided with cross-shaped projection The toner cap 11*fc* in this example is provided with cross-shaped projection C1 extending outwardly as shown in FIG. 8, and projections and recesses C15 are formed inside.

A rib A11 and a retainer A12 are provided in a similar manner as with the circular toner cap 11*fa*.

As shown in FIG. 29, (*b*), the cap is first cut along m-n,p-q lines by a cutter J1 at the crossing part of the cross-shaped projection C1.

Before cutting, the m-n,p-q parts are pinched by the tool J2 such as a small pench or the like to expand the side facing outward at the crossing portion of the cross-shaped projection C1.

Figure 30:
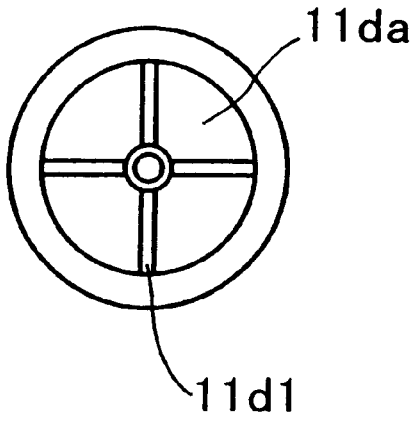
FIG. 30 is a front view of a toner filling opening.
Figure 31:
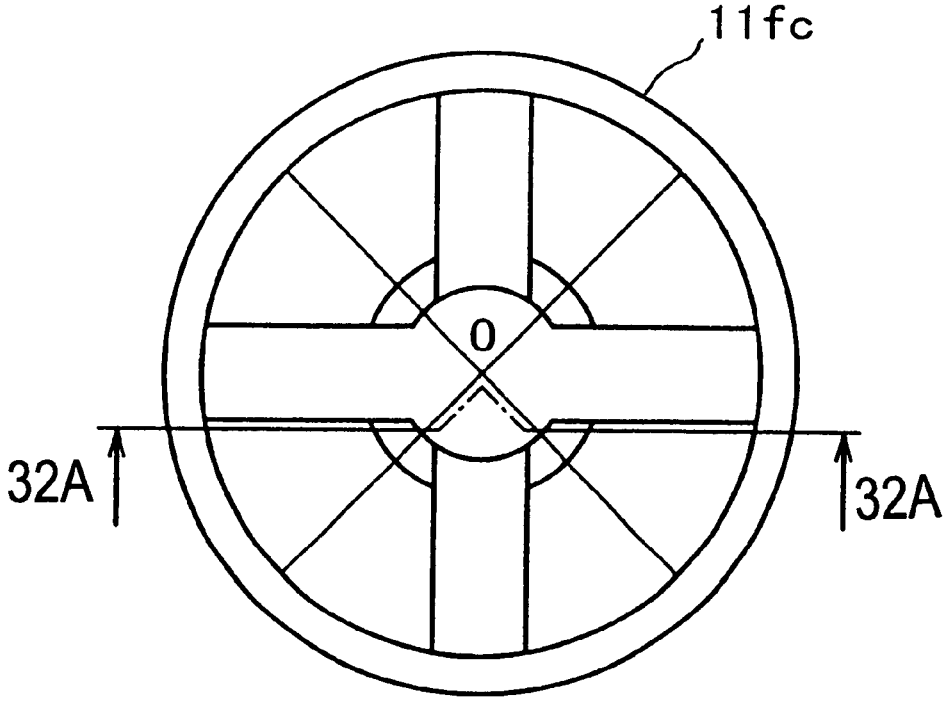
FIG. 31 is a front view of a toner cap.

This is done in order to avoid damage to the cross-shaped rib portion 11*dal* (FIG. 30) provided in the toner filling opening 11*da* of the toner container 11A at the back side of the cross-shaped projection C1.

The cutting line may not continue completely at the boundary with the portion h-m,n-i, but it may be ignored.

This is because in the case of cap removal with the tool J2, the cap 11*fc* is already easy to deform.

Then, the bottom 15 of the toner cap 11*fc* is cut along h-m, j-p, i-n and k-q.

The cutting line E is inclined by 45 degrees relative to the crossing projections C1 and extends toward the crossing portion of the projection C1 and the bottom portion between the side of the crossing portion of the projection C1 and the bottom portion.

As shown in FIG. 29, (*b*), a part of the cross-shaped projection C1 in the bottom of the toner cap 11*fc* is erected at the intersection O by an ice pick, and the free end O' is raised from the bottom.

The rigidity of the retainer A12 portion of the toner cap 11*fc* decreases because of the formation of the opening G below the free end O' raised from the intersection O, and therefore, the rigidity of the engaging portion 11*fc*2 decreases.

The rigidity of the retainer A12 particularly decreases.

3) as shown in FIG. 32(*a*), the free end O' is pinched by a tool J2 such as a small pench, and the tool J2 is raised in direction C, and then the diameter of the retainer A12 reduces, and the lowest portion of the bottom 15 of the toner cap deforms to expand outwardly.

When the tool J2 is raised, the toner cap 11*fc* is removed from the circular toner filling opening 11*da*.

(3) disassembling method of a triangular shape toner cap 11*fb*

Figure 21:
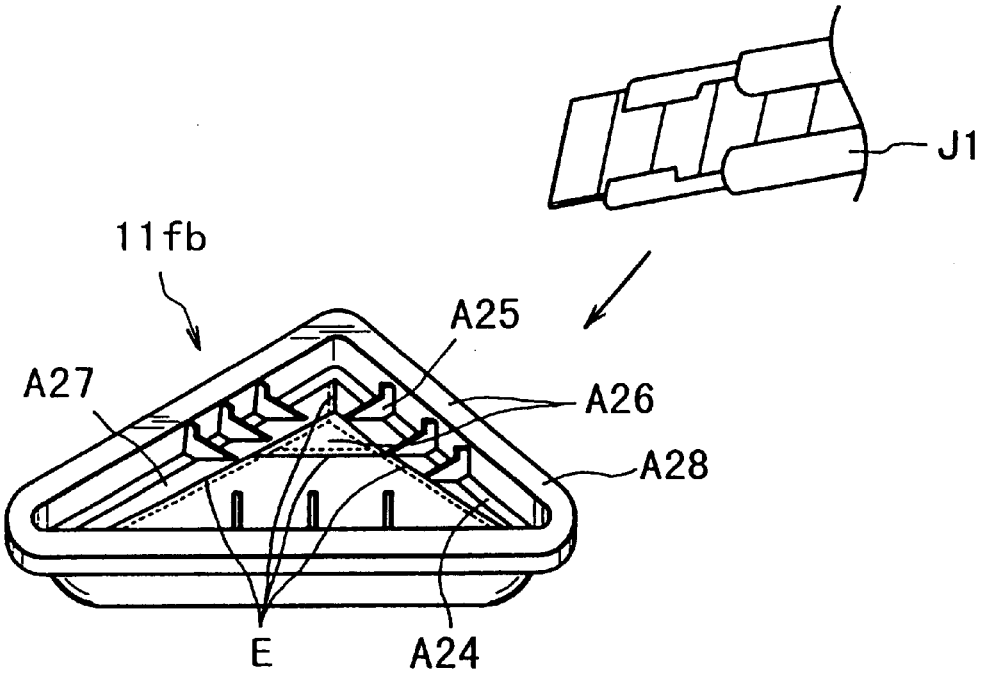
FIG. 21 is a perspective view of an example of a notch of a toner cap according to Embodiment 2 of the present invention.

As shown in FIG. 21, the toner cap 11*fb* is cut at the triangular-pyramid-like bottom portion by a cutter J1 along an edge line.

Figure 22:
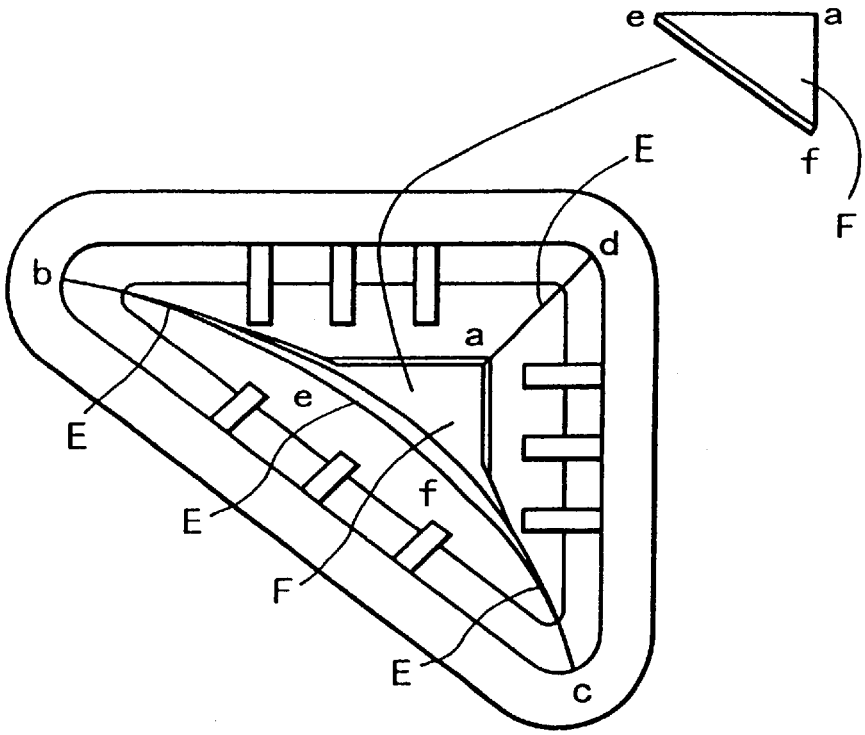
FIG. 22 is a front view showing a state before dismounting of the toner cap according to Embodiment 2 of the present invention.
Figure 23:
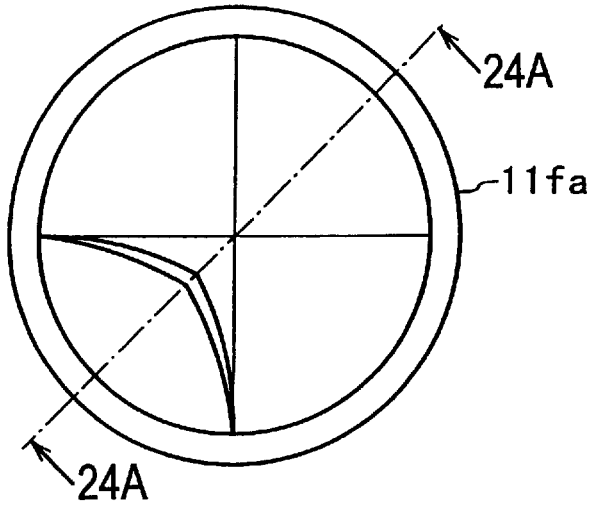
FIG. 23 is a front view showing a state before dismounting of the toner cap according to Embodiment 1 of the present invention.

The ends of the cutting line E, as shown in FIG. 22 are at the corners b, c and d of the toner cap 11*fa*.

As indicated by line b-e-a-d, the cap is cut from the corner b of the corner d along E, and the as indicated by line a-f-c, it is cut from the corner C to the line b-e-a-d, then an intersection a is provided.

As indicated by line c-f-a-d, the cap may be cut from the corner c to the corner d, and then, as indicated by line a-e-b, the cap may be cut from the corner d to the line c-f-a-d to provide an intersection a.

The triangle aef, as shown in FIG. 21, defines the apex of the cap know A26, and the line a-d, line e-b, and line f-c are bottom line of the triangular-pyramid-like of the toner cap 11*fb*.

The cap is cut between the line a-b and the line a-c along e-f.

The cutting along E between e and f, is such that thin skin remains (half-cut, not completely penetrates the bottom portion A24).

At this time, there already exist cutting lines b-e and c-f penetrating the bottom of the toner cap 11*fb*, and the line b-e-f-c is generally rectilinear. Therefore, the cutter J1 is set between the line b-e, and is moved down between f-c.

The intersection a is erected by a tool such as a ice pick, and a portion F of the triangular shape aef is pinched by unshown tool to tear along the line ef, by which a hole F' is provided.

4) after the cutting along the line E, as indicated by FIG. 26, (*a*), the toner cap 11*fb* engaged in the toner frame 11 has the same position of the notch A22.

Here, the line H of the hole F' between the lines ef is pinched by a tool 32 and is pulled out, by which as shown in FIG. 26, (*b*), the notch A22 comes outside the edge of the toner filling opening B1.

Further the tool is pulled in the direction D, by which the toner cap 11*fb* is removed from the toner filling opening B1.

Another example of cutting will be described.

As shown in FIG. 22, the cap is first cut along a-e,e-f,f-a (the order is not limited to this), and then the triangle aef (F) is removed.

Subsequently, the cap is cut along a-d,e-b,f-c (the order is not limited to this).

With this cutting method, only linear cutting lines are used, so that handling is easy.

Figure 27:
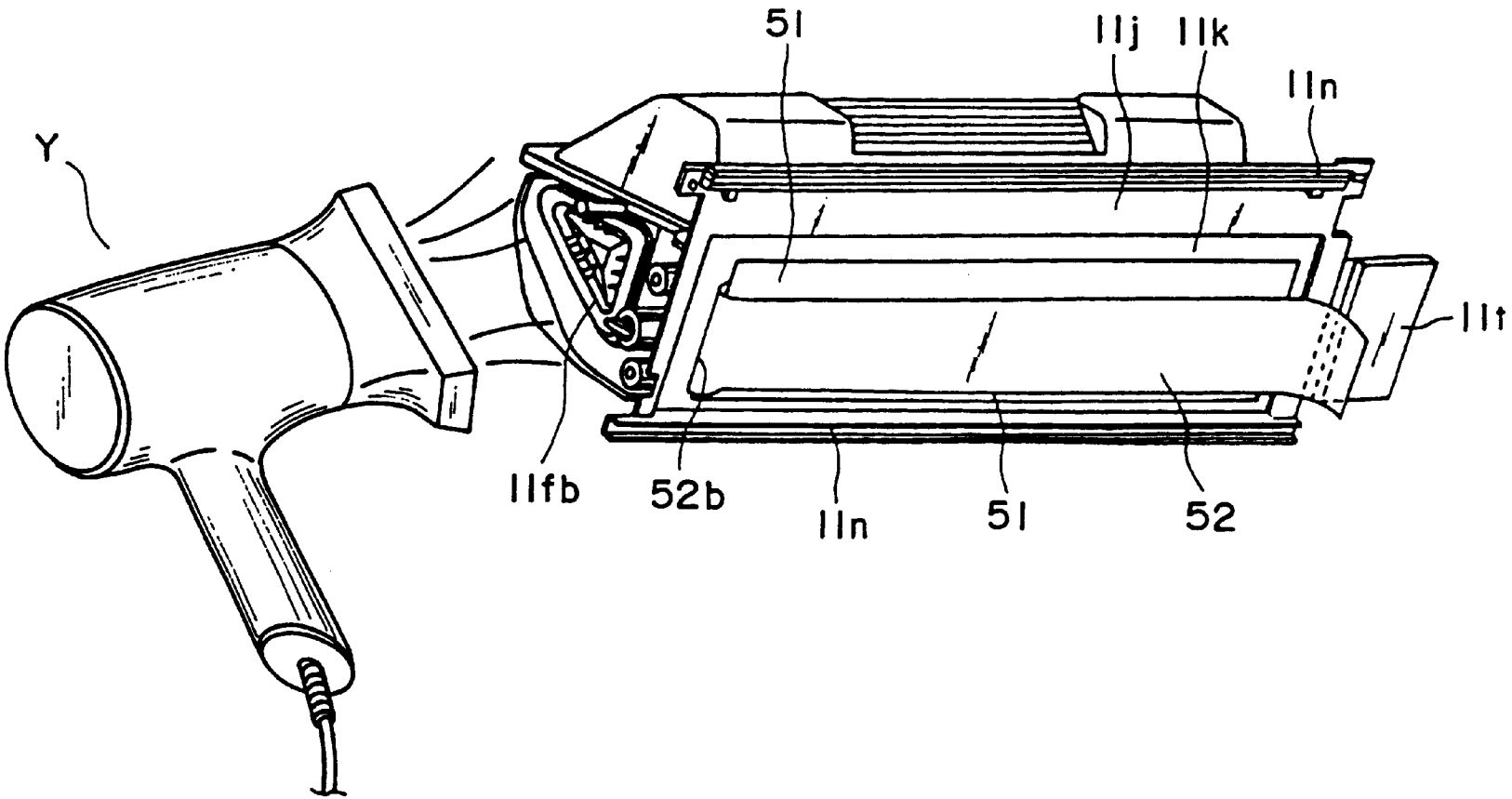
FIG. 27 is a perspective view showing heating when the toner cap is dismounted.
Figure 28:
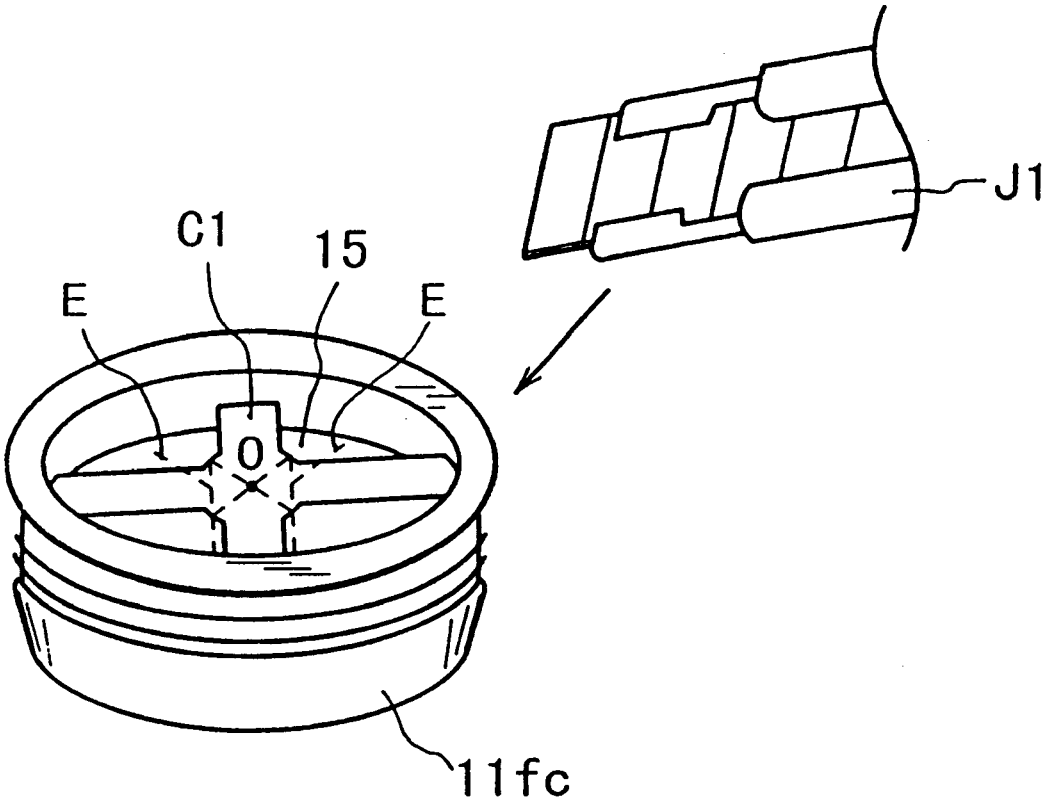
FIG. 28 is a perspective view of a toner cap having a cross-shaped projection on its bottom portion.

(4) in the foregoing examples, as shown in FIG. 27, it is preferably to heat the toner cap 11*fa*,11*fb* (11*fb* in the Figure) by a dryer Y or the like beforehand, since then the toner cap 11*fa*,11*fb*, is softened to decrease in the rigidity, and therefore, the toner filling opening 11*d* is easily pulled out.

The embodiments are summarized as follows:

In a method of disassembling a toner accommodating container to recycle it, wherein the toner accommodating container comprises a filling port 11*d* (11*da*,11*db*) for permitting filling of toner in a side of a lower frame 11*b* constituting a main body of the toner container, a cap 11*f* (11*fa*,11*fb*, 11*fc*) press-fitted in the filling port 11*d* to seal the filling port 11*d*, the cap 11*f* per se is cut E at portions other than an engaging portion 11*fa*2 relative to the filling port 11*d* as shown in FIGS. 19,21 with a cutter J1, and the cap 11*f* is deformed within the filling port 11*d* to decrease the rigidity of the cap 11*f* per se, and then the press-fitting is eased, and the cap 11*f* is removed. By doing so, the rigidity of the toner cap 11*f* significantly decreases, and simultaneously the cap 11*f* of the cut portion can be pinched by a pinching tool J2.

Therefore, the tool J2 is not liable to touch the lower frame 11*b*, and the cutting provides only cutting lines without chips, and therefore, there is no liability that chips enter the toner container 11A.

Since the cap 11*f* is cut along at least two lines source to provide an intersection (O,a,e,f or the like) of cutting lines, the cut portions can be erected by a tool having a sharp tip, and therefore, the disassembling operation is easy.

By cutting out a part of the cap 11*f*, as shown in FIG. 22, in the manner that intersections a,e,f are generally at the apexes of the triangular shape, by which the rigidity of the cap 11*f* (in this example, 11*fb*) is significantly lowered.

Additionally, in this example, the points b,c,d at the edge of the cap 11*fb* correspond to the apexs of the rectangular triangler constituting the toner cap 11*fb*, and therefore, the reduction of the rigidity is remarkable.

Furthermore, there is provided a rectangular hole F' provided by connecting intersections a,e,f, so that pinching action is easy.

(embodiment and results)

The toner containers 11A of the embodiments are tested in the disassembling operation of the toner container and the process cartridge to check the cutting operation of the toner cap and the removing operation of the cap including the required the period of time for the copying operation.

The toner caps tested were as follows:

1. toner cap material: representative materials include low density polyethylene (LDPE), high density polyethylene (HDPE), polypropylene (PP), polystyrene (PS), ABS (exactly the same material as the toner container used, with the same properties)
2. Basic thickness: 0.5 mm, 1.5 mm or 2 mm
3. Configuration: a toner cap having a circular projected configuration (Embodiment 1) having a flat bottom surface (bottom 15 in FIG. 16) or having a bottom with a projectionj (bottom surface C15 having a cross-shaped projection C1 as shown in FIG. 8).

A toner cap having a substantially triangular shape projected configuration (Embodiment 2).

The cutting operation was carried out using a cutter knife J1 or an ultrasonic cutter in the manner shown in FIGS. 19,20.

FIGS. 19,20 show an example in which two linear cuts E are crossed at an intersection, and as shown in FIG. 20, the quadrant segment indicated by the point O portion is erected from the bottom surface 15,C15 (free end O').

The typical example is a toner cap 11*fa*.

On the other hand, in FIGS. 21,22, the cutting lines E are radial lines (line a-b, a-c,a-d) with an intersection of three linear lines, and the cuting line is further provided between a point e between a-b and a point f between a-c, to cut out a part of the toner cap, and the resultant chip F is removed. The typical example of this case is the toner cap 11*fb*.

Figure 24A:
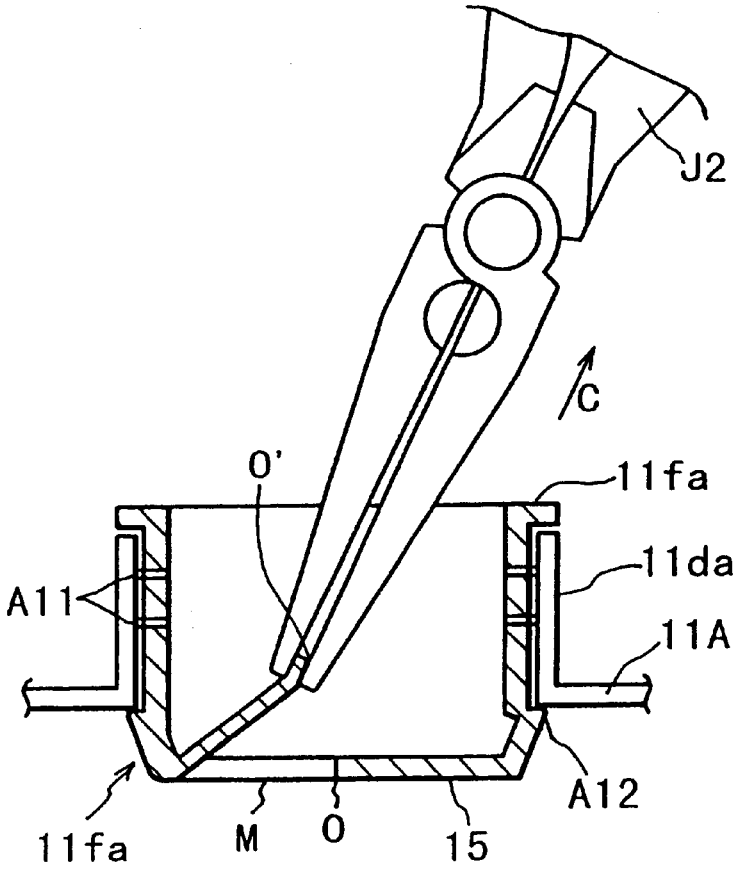
FIG. 24 is an A-Asectional view in FIG. 23 according to Embodiment 1 of the present invention.
Figure 24B:
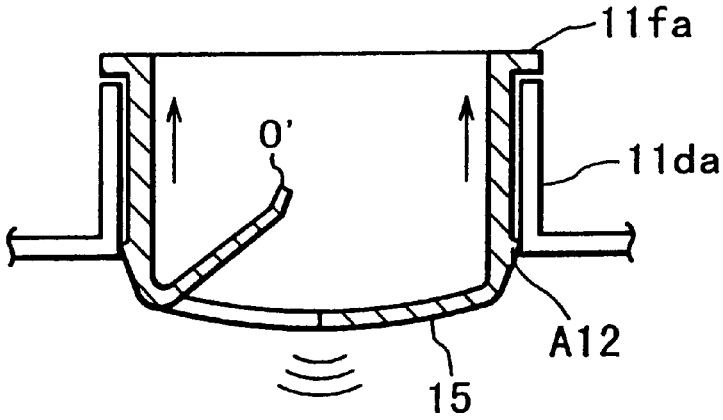
Figure 25:
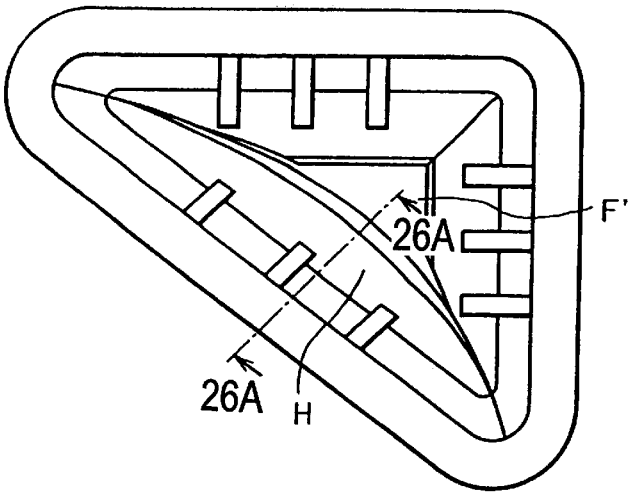
FIG. 25 is a front view showing a state before dismounting of the toner cap according to Embodiment 2 of the present invention.

As for the dismounting of the toner cap, dismounting as shown in FIGS. 24,25, the portion of the toner cap adjacent the free end O' of the bottom is pinched by a pinching tool J2 (for example, pinch), and it is pulled out such that toner cap deforms in the toner filling opening by which the engagement between the toner filling opening and the toner cap is eased, and then the toner cap is pulled out.

As shown in FIG. 27, the toner cap was heated or warmed beforehand for the purpose of quick operation.

The results are shown in Table 1 (1-1, 1-2, 1-3) and Table 2 (2-1, 2-2, 2-3). The results exhibit the applicability of the present invention.

More particularly, hard polystyrene (PS) and ABS resin material require longer time for the cutting, and in the case that use is made with the ultrasonic cutter, the cutting time is a uniform irrespective of the materials and basic thicknesses.

However, in the case of polystyrene (PS) and ABS resin material, burrs tend to produce, and therefore, the number of cutting operations are desirably limited, preferably once.

TABLE 1

| EMB. NOTE | CAP SHAPE | MAT. | BASIC THICK (ms) | Cutting of toner cap: REQUIRED CUTTING TIME (sec) USUAL BLADR | USW CUTTER | CUTTABLE? | NOTE |
|---|---|---|---|---|---|---|---|
| 1-1-1 | CIRCULAR | LDPE | 0.5 | 5–10 | 10–15 | yes | *1 |
| 1-1-2 | FLAT | | 1.0 | 8–10 | 10–15 | yes | |
| 1-1-3 | BOTTOM | | 1.5 | 10–15 | 10–15 | yes | |
| 1-1-4 | | | 2.0 | 20–25 | 10–15 | yes | |
| 1-2-1 | | EDPE | 0.5 | 5–10 | 10–15 | yes | *1 |
| 1-2-2 | | | 1.0 | 10–15 | 10–15 | yes | |
| 1-2-3 | | | 1.5 | 12–17 | 10–15 | yes | |
| 1-2-4 | | | 2.0 | 25–30 | 10–15 | yes | |
| 1-3-1 | | PP | 0.5 | 5–10 | 10–15 | yes | *1 |
| 1-3-2 | | | 1.0 | 10–15 | 10–15 | yes | |
| 1-3-3 | | | 1.5 | 15–20 | 10–15 | yes | |
| 1-3-4 | | | 2.0 | 25–30 | 10–15 | yes | |
| 1-4-1 | | PS | 0.5 | 10–15 | 10–15 | yes | *2 |
| 1-4-2 | | | 1.0 | 15–20 | 10–15 | yes | *2 |
| 1-4-3 | | | 1.5 | 20–25 | 10–15 | yes | *2 |
| 1-4-4 | | | 2.0 | >30 | 10–15 | yes | *2 |
| 1-5-1 | | ADS | 0.5 | 10–15 | 10–15 | yes | *2 |
| 1-5-2 | | | 1.0 | 15–20 | 10–15 | yes | *2 |
| 1-5-3 | | | 1.5 | 20–25 | 10–15 | yes | *2 |
| 1-5-4 | | | 2.0 | >30 | 10–15 | yes | *2 |
| 2-1-1 | CIRCULAR | LDPE | 0.5 | 5–10 | 13–18 | yes | *1 |
| 2-1-2 | FLAT | | 1.0 | 8–13 | 13–18 | yes | |
| 2-1-3 | BOTTOM | | 1.5 | 10–15 | 13–18 | yes | |
| 2-1-4 | | | 2.0 | 20–25 | 13–18 | yes | |
| 2-2-1 | | EDPE | 0.5 | 5–10 | 13–18 | yes | *1 |
| 2-2-2 | | | 1.0 | 10–15 | 13–18 | yes | |
| 2-2-3 | | | 1.5 | 12–17 | 13–18 | yes | |
| 2-2-4 | | | 2.0 | 25–30 | 13–18 | yes | |
| 2-3-1 | | PP | 0.5 | 5–10 | 13–18 | yes | *1 |
| 2-3-2 | | | 1.0 | 10–15 | 13–18 | yes | |
| 2-3-3 | | | 1.5 | 15–20 | 13–18 | yes | |
| 2-3-4 | | | 2.0 | 25–30 | 13–18 | yes | |
| 2-4-1 | | PS | 0.5 | 10–15 | 13–18 | yes | *3 |
| 2-4-2 | | | 1.0 | 15–20 | 13–18 | yes | *3 |
| 2-4-3 | | | 1.5 | 20–25 | 13–18 | yes | *3 |
| 2-4-4 | | | 2.0 | >30 | 13–18 | yes | *3 |
| 2-5-1 | | ADS | 0.5 | 10–15 | 13–18 | yes | *3 |
| 2-5-2 | | | 1.0 | 15–20 | 13–18 | yes | *3 |
| 2-5-3 | | | 1.5 | 20–25 | 13–18 | yes | *3 |
| 2-5-4 | | | 2.0 | >30 | 13–18 | yes | *3 |
| 3-1-1 | GENERAL- | LDPE | 0.5 | 5–10 | 10–15 | yes | *1 |
| 3-1-2 | LY | | 1.0 | 8–13 | 10–15 | yes | |
| 3-1-3 | TRIANGLE | | 1.5 | 10–15 | 10–15 | yes | |
| 3-1-4 | | | 2.0 | 20–25 | 10–15 | yes | |
| 3-2-1 | | EDPE | 0.5 | 5–10 | 10–15 | yes | *1 |
| 3-2-2 | | | 1.0 | 10–15 | 10–15 | yes | |
| 3-2-3 | | | 1.5 | 12–17 | 10–15 | yes | |
| 3-2-4 | | | 2.0 | 25–30 | 10–15 | yes | |
| 3-3-1 | | PP | 0.5 | 5–10 | 10–15 | yes | *1 |
| 3-3-2 | | | 1.0 | 10–15 | 10–15 | yes | |
| 3-3-3 | | | 1.5 | 15–20 | 10–15 | yes | |
| 3-3-4 | | | 2.0 | 25–30 | 10–15 | yes | |
| 3-4-1 | | PS | 0.5 | 10–15 | 10–15 | yes | *3 |
| 3-4-2 | | | 1.0 | 15–20 | 10–15 | yes | *3 |
| 3-4-3 | | | 1.5 | 20–25 | 10–15 | yes | *3 |
| 3-4-4 | | | 2.0 | >30 | 10–15 | yes | *3 |
| 3-5-1 | | ADS | 0.5 | 10–15 | 10–15 | yes | *3 |
| 3-5-2 | | | 1.0 | 15–20 | 10–15 | yes | *3 |
| 3-5-3 | | | 1.5 | 20–25 | 10–15 | yes | *3 |
| 3-5-4 | | | 2.0 | >30 | 10–15 | yes | *3 |

*1: Toner leakage during transportation in some cases.
*2: Small burrs are produced in some cases.
*3: Burrs fall in some cases.

TABLE 2

| EMB. NOTE | CAP SHAPE | MAT. | BASIC THICK (ms) | Cutting of toner cap (when the toner cap is heated beforehand, it is heated to 45–50 degrees C). REQUIRED CUTTING TIME (sec) USUAL BLADR | USW CUTTER | CUTTABLE? | NOTE |
|---|---|---|---|---|---|---|---|
| 1-1-1 | CIRCULAR | LDPE | 0.5 | 5–7 | 10–15 | yes | *1 |
| 1-1-2 | FLAT | | 1.0 | 5–10 | 10–15 | yes | |
| 1-1-3 | BOTTOM | | 1.5 | 7–12 | 10–15 | yes | |
| 1-1-4 | | | 2.0 | 15–20 | 10–15 | yes | |
| 1-2-1 | | EDPE | 0.5 | 5–7 | 10–15 | yes | *1 |
| 1-2-2 | | | 1.0 | 5–10 | 10–15 | yes | |
| 1-2-3 | | | 1.5 | 7–12 | 10–15 | yes | |
| 1-2-4 | | | 2.0 | 20–25 | 10–15 | yes | |
| 1-3-1 | | PP | 0.5 | 5–7 | 10–15 | yes | *1 |
| 1-3-2 | | | 1.0 | 5–10 | 10–15 | yes | |
| 1-3-3 | | | 1.5 | 10–15 | 10–15 | yes | |
| 1-3-4 | | | 2.0 | 20–25 | 10–15 | yes | |
| 1-4-1 | | PS | 0.5 | 8–13 | 10–15 | yes | *2 |
| 1-4-2 | | | 1.0 | 12–17 | 10–15 | yes | *2 |
| 1-4-3 | | | 1.5 | 18–23 | 10–15 | yes | *2 |
| 1-4-4 | | | 2.0 | >30 | 10–15 | yes | *2 |
| 1-5-1 | | ADS | 0.5 | 8–13 | 10–15 | yes | *2 |
| 1-5-2 | | | 1.0 | 12–17 | 10–15 | yes | *2 |
| 1-5-3 | | | 1.5 | 18–23 | 10–15 | yes | *2 |
| 1-5-4 | | | 2.0 | >30 | 10–15 | yes | *2 |
| 2-1-1 | CIRCULAR | LDPE | 0.5 | 5–7 | 10–15 | yes | *1 |
| 2-1-2 | FLAT | | 1.0 | 5–10 | 10–15 | yes | |
| 2-1-3 | BOTTOM | | 1.5 | 7–12 | 10–15 | yes | |
| 2-1-4 | | | 2.0 | 15–20 | 10–15 | yes | |
| 2-2-1 | | EDPE | 0.5 | 5–7 | 10–15 | yes | *1 |
| 2-2-2 | | | 1.0 | 5–10 | 10–15 | yes | |
| 2-2-3 | | | 1.5 | 7–12 | 10–15 | yes | |
| 2-2-4 | | | 2.0 | 20–25 | 10–15 | yes | |
| 2-3-1 | | PP | 0.5 | 5–7 | 10–15 | yes | *1 |
| 2-3-2 | | | 1.0 | 5–10 | 10–15 | yes | |
| 2-3-3 | | | 1.5 | 10–15 | 10–15 | yes | |
| 2-3-4 | | | 2.0 | 20–25 | 10–15 | yes | |
| 2-4-1 | | PS | 0.5 | 8–13 | 10–15 | yes | *3 |
| 2-4-2 | | | 1.0 | 12–17 | 10–15 | yes | *3 |
| 2-4-3 | | | 1.5 | 18–23 | 10–15 | yes | *3 |
| 2-4-4 | | | 2.0 | >30 | 10–15 | yes | *3 |
| 2-5-1 | | ADS | 0.5 | 8–13 | 10–15 | yes | *3 |
| 2-5-2 | | | 1.0 | 12–17 | 10–15 | yes | *3 |
| 2-5-3 | | | 1.5 | 18–23 | 10–15 | yes | *3 |
| 2-5-4 | | | 2.0 | >30 | 10–15 | yes | *3 |
| 3-1-1 | GENERAL- | LDPE | 0.5 | 5–7 | 10–15 | yes | *1 |
| 3-1-2 | LY | | 1.0 | 5–10 | 10–15 | yes | |
| 3-1-3 | TRIANGLE | | 1.5 | 7–12 | 10–15 | yes | |
| 3-1-4 | | | 2.0 | 15–20 | 10–15 | yes | |
| 3-2-1 | | EDPE | 0.5 | 5–7 | 10–15 | yes | *1 |
| 3-2-2 | | | 1.0 | 5–10 | 10–15 | yes | |
| 3-2-3 | | | 1.5 | 7–12 | 10–15 | yes | |
| 3-2-4 | | | 2.0 | 20–25 | 10–15 | yes | |
| 3-3-1 | | PP | 0.5 | 5–7 | 10–15 | yes | *1 |
| 3-3-2 | | | 1.0 | 5–10 | 10–15 | yes | |
| 3-3-3 | | | 1.5 | 10–15 | 10–15 | yes | |
| 3-3-4 | | | 2.0 | 20–25 | 10–15 | yes | |
| 3-4-1 | | PS | 0.5 | 8–13 | 10–15 | yes | *3 |
| 3-4-2 | | | 1.0 | 12–17 | 10–15 | yes | *3 |
| 3-4-3 | | | 1.5 | 18–23 | 10–15 | yes | *3 |
| 3-4-4 | | | 2.0 | >30 | 10–15 | yes | *3 |
| 3-5-1 | | ADS | 0.5 | 8–13 | 10–15 | yes | *3 |
| 3-5-2 | | | 1.0 | 12–17 | 10–15 | yes | *3 |
| 3-5-3 | | | 1.5 | 18–23 | 10–15 | yes | *3 |
| 3-5-4 | | | 2.0 | >30 | 10–15 | yes | *3 |

*1: Toner leakage during transportation in some cases.

*2: Small burrs are produced in some cases.

*3: Burrs fall in some cases.

As regards the basic thickness of the toner cap, the cutting was possible when it was 0.5 mm, but as regards the stability in transportation, the reproducibility is uncertain, and the toner leakage sometimes occur from the engaging portion of the toner cap.

When the basic thickness is 2 mm, the fitting of the toner cap required a relatively long time in the case of any material (2.5–30 sec. although less than 2.2 sec is desirable).

Therefore, in the removing system wherein the toner cap is partly cut and is then removed, the basic thickness of 1.0–1.5 mm is desirable in terms of the required time.

Furthermore, as shown in Table 2, the toner cap was cut after it is heated, and the required time could be reduced by 2–5 sec.

In the embodiments described in the foregoing, the projected configuration of the toner cap 11*f* is circular as shown in FIGS. 8,9, or generally triangular as shown in FIG. 10, but other polygonal shapes are usable, and non-circular shapes are usable.

The material of the toner cap 11*f* is low density polyethylene, and the material of the main body of the container is shock-resistant polystyrene HIPS, but as regards the Olsen rigidity and bending elastic modulus, the numerical ranges described above are preferable without specific limitation to the material.

For example, the toner cap 11*f* may be made of polypropylene, and the main body of the toner container may be of shock-resistant polystyrene HIPS, ABS, polyphenylene ether PPE or polyphenylene oxide PPO.

As described in the foregoing, according to the present invention, the following advantageous effects are provided.

1. When the is removed, the damage or crack of the filling port portion by the use of pinching tool and the entrance of the resulting chips can be avoided.

The operation of the cap removing step is unified to "the cap per se is partly cut and then is deformed within the filling port and then is removed from the filling port", so that cap can be removed in the same manner irrespective of the configuration of the cap, and the container or the process cartridge is reused.

This eliminates the necessity of classification of the toner containers and process cartridges collected back for recycling.

While the invention has been described with reference to the structures disclosed herein, it is not confined to the details set forth and this application is intended to cover such modifications or changes as may come within the purposes of the improvements or the scope of the following claims.

What is claimed is:

1. A method of disassembling, for reuse, a toner accommodating container including a main body for accommodating toner, an opening for permitting filling of the toner and a cap press-fitted with an engaging portion of said opening to plug said opening, said method comprising:

a first step of partly cutting said cap without cutting the engaging portion; and a second step of removing the cap from the engaging portion while releasing engagement between the cap and the engaging portion by deforming the cap using a cut portion provided by said cutting step.

2. A method according to claim 1, wherein said cut portion includes a first cut along a first line and a second cut along a second line crossing therewith.

3. A method according to claim 1, wherein in said second step, the cap is deformed by raising a part of the cap from the cut portion.

4. A method according to claim 1, further comprising a third step of removing a part of the cap along the cut portion, before said second step and after said first step.

5. A method according to claim 1, wherein the cap is made of polyethylene or polypropylene resin material.

6. A method according to claim 1, wherein a thickness of the cap is 1–1.5 mm.

7. A method according to claim 1, wherein the cap is substantially triangular in shape.

8. A method according to claim 1, wherein the engaging portion is provided with a projection extending circumferentially in a direction perpendicular to a direction of insertion of the cap, and the cap is provided on its ourter circumference with a groove portion for engagement with the projection.

9. A method according to claim 1, wherein the opening is provided in a longitudinal end portion of the main body of the container.

10. A method of claim 1, further comprising a step of warming the cap before said first step.

11. A method according to any one of claims 1–10, wherein said toner accommodating container is mounted to a developing device for developing an electrostatic image formed on an image bearing member.

12. A method according to claim 1, wherein the developing device constitutes, with the image bearing member, a process cartridge detachably mountable to a main assembly of an image forming apparatus.

* * * * *

UNITED STATES PATENT AND TRADEMARK OFFICE

CERTIFICATE OF CORRECTION

PATENT NO. : 6,219,506 B1 
DATED : April 17, 2001
INVENTOR(S) : Hiroumi Morinaga et al.

It is certified that error appears in the above-identified patent and that said Letters Patent is hereby corrected as shown below:

Title page,
Item [57], ABSTRACT,
Line 5, “the” (2nd occurrence) should be deleted.
Line 9, “cuttin” should read -- cutting- --.

Column 1,
Line 23, "onec" should read -- once --.

Figure 6A:
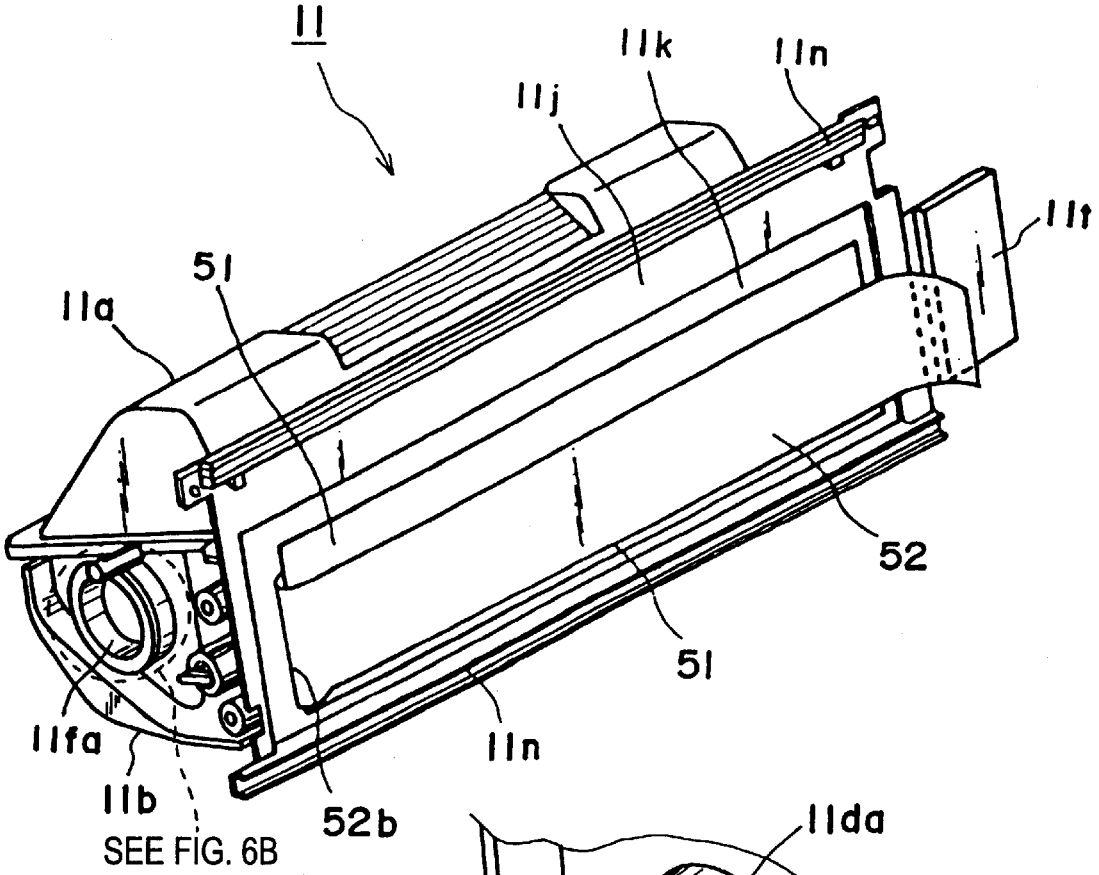
FIG. 6 is a perspective view of an outer appearance of a toner container according to an embodiment of the present invention.
Figure 6B:
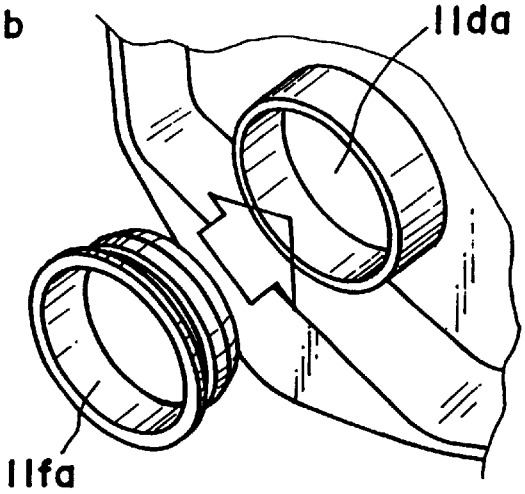

Column 2,
Line 4, "dameged." should read -- damaged --.
Line 7, "recent" should be deleted.
Line 20, "disassemblying" should read -- disassembling --.
Line 28, "disassemblying" should read -- disassembling --.
Line 65, "FIG. 6 is" should read -- FIGS. 6A and 6B are --, and "view" should read -- views --.

Figure 7A:
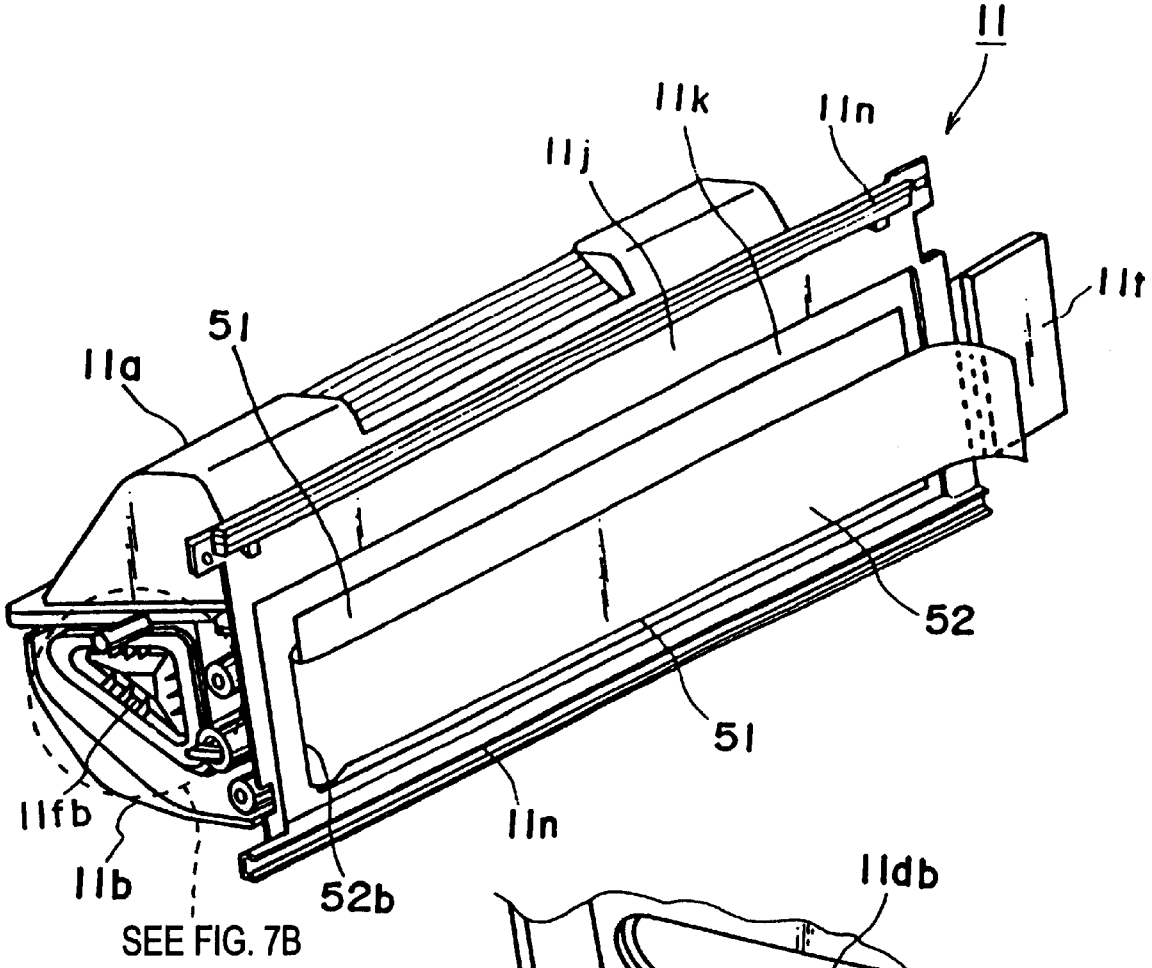
FIG. 7 is a perspective view of an outer appearance of a toner container according to Embodiment 2 of the present invention.
Figure 7B:
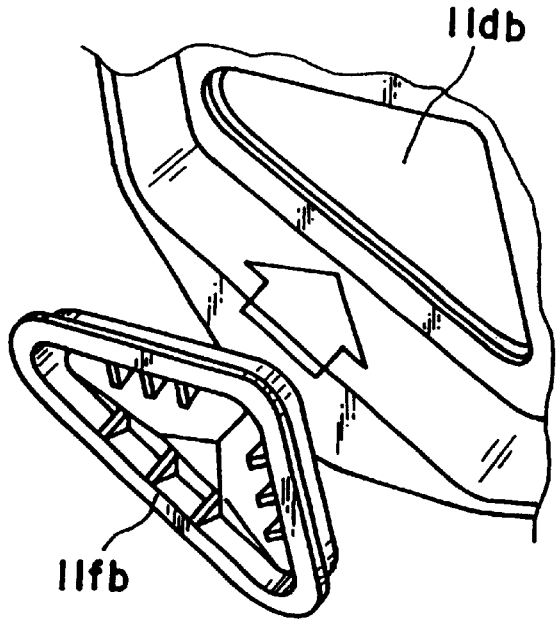
Figure 8A:
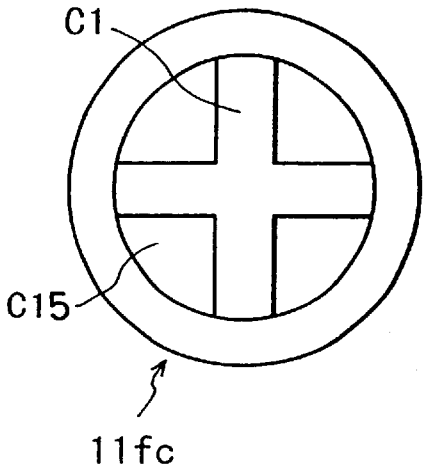
FIG. 8 is an illustration of a circular toner cap (projected configuration) having a cross-shaped projection on the bottom surface of the cap, according to Embodiment 1 of the present invention, wherein (a) is a front view, and (b) is a side view.
Figure 8B:
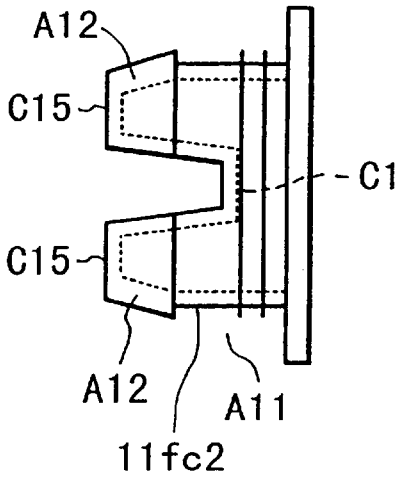
Figure 26A:
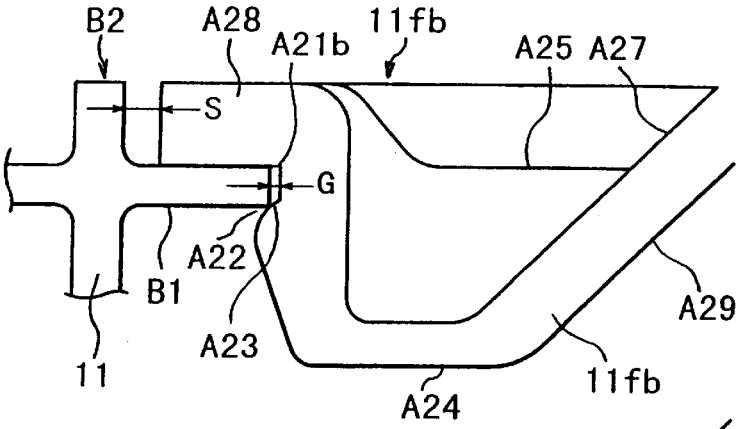
FIG. 26 is a B-Bsectional view of FIG. 25.
Figure 26B:
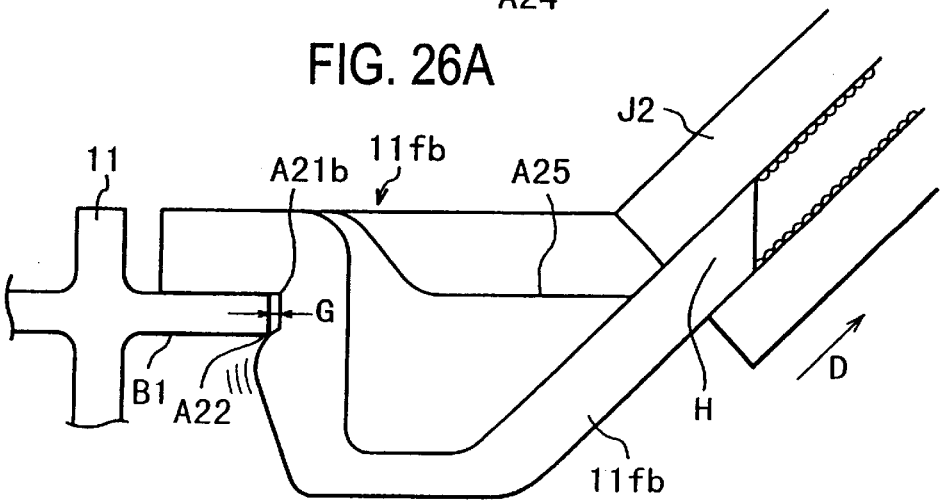

Column 3,
Line 1, "FIG. 7 is" should read -- FIGS. 7A and 7B are --, and "view" should read -- views --.
Line 4, "FIG. 8 is" should read -- FIGS. 8A, 8B are --, and "view" should read -- views --.
Line 57, "FIG. 24 is" should read -- FIGS. 24A, 24B are --, and "view" should read -- view --.
Line 63, "FIG. 26 is" should read -- FIGS. 26A, 26B are --, and "view" should read -- views --.

Figure 29A:
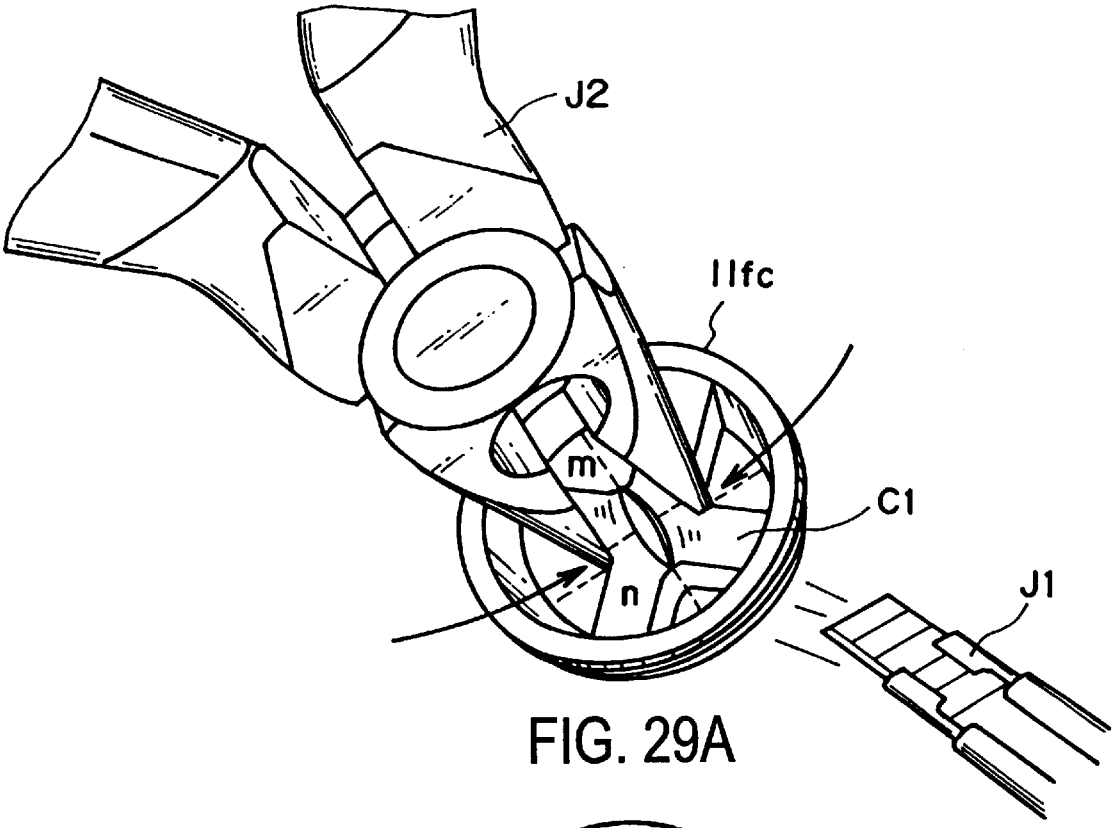
FIG. 29 illustrates a removing method of a toner cap, wherein (a) is a perspective view, and (b) is a top plan view.
Figure 29B:
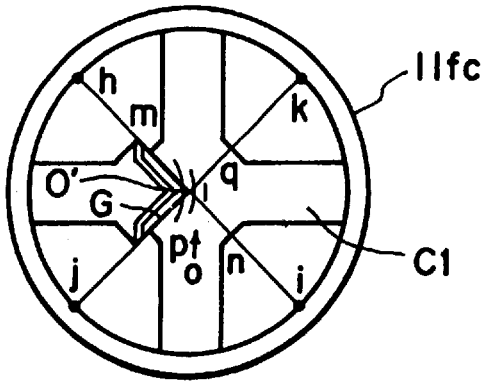
Figure 32A:
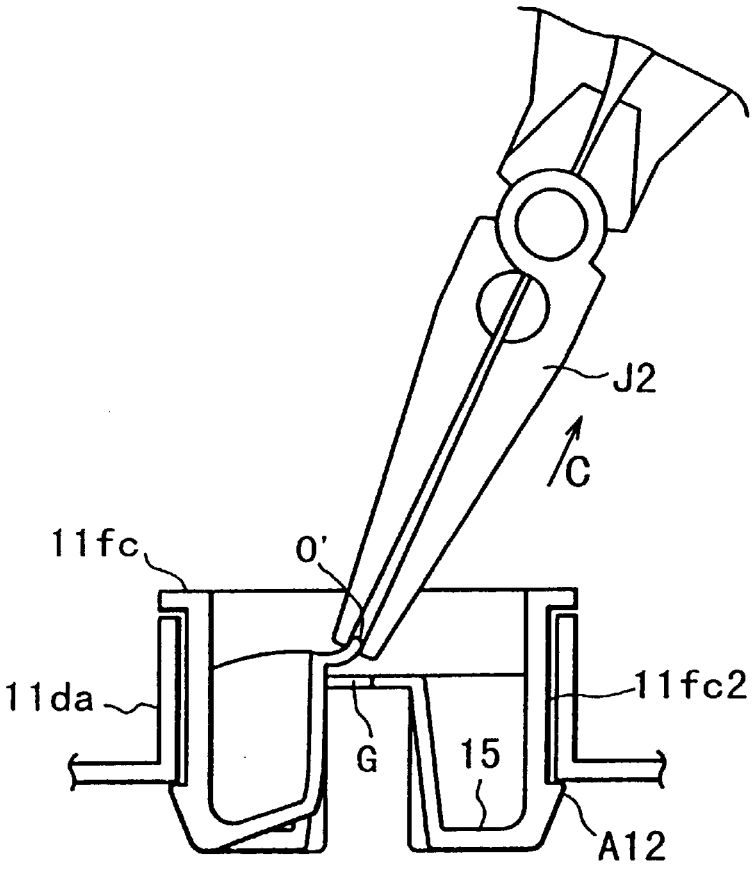
FIG. 32 is an A-Asectional view of FIG. 31.
Figure 32B:
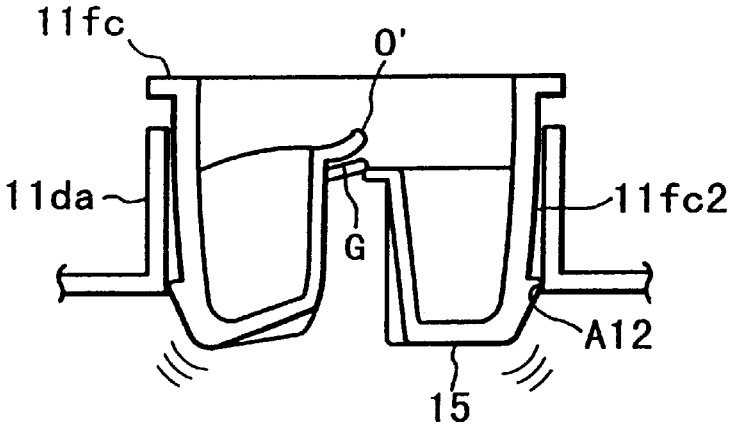

Column 4,
Line 1, "FIG. 29" should read -- FIGS. 29A, 29B --, and "illustrates" should read -- illustrate --.
Line 5, "FIG. 32 is" should read -- FIGS. 32A, 32B are --; "an" should be deleted; and "view" should read -- views --.
Line 25, "refers" should read -- refer --.
Line 48, "intention." should read -- invention --.
Line 58, "it" should read -- is --.

UNITED STATES PATENT AND TRADEMARK OFFICE

CERTIFICATE OF CORRECTION

PATENT NO. : 6,219,506 B1
DATED : April 17, 2001
INVENTOR(S) : Hiroumi Morinaga et al.

It is certified that error appears in the above-identified patent and that said Letters Patent is hereby corrected as shown below:

Column 5,
Line 14, "Press" should be deleted.
Line 26, "Of" should read -- On --.
Line 43, "supplied" should read -- supplies --.
Line 54, "and" should be deleted.

Column 6,
Line 40, "partridge" should read -- cartridge --, and "is a" should read -- is --.

Column 7,
Line 3, "apparatus" should read -- apparatus. --.
Line 6, "Press--" should be deleted.
Line 13, "B" should read -- B. --.
Line 28, "projected" (2nd occurrence) should be deleted.
Line 39, "cleansing" should read -- cleaning --.
Line 50, "recesss" should read -- recesses --.
Line 52, "portions" should read -- portion--.

Column 8,
Line 1, "Hubs" should read -- As --.
Line 7, "Press" should be deleted.
Line 22, "19has" should read -- 19 has --.
Line 38, "(13a R," should read -- 13aR, --.
Line 63, "direciton" should read -- direction --.
Line 66, "frame" should read -- flange --.

Column 9,
Lines 4 and 42, "limted" should read -- limited --.

Column 10,
Line 23, "are provided" should be deleted.
Lines 40 and 61, "recssed" should read -- recessed --.

Column 11,
Line 4, “move” should read -- to move --.
Line 24, “vertially” should read -- vertically --.

Column 12,
Line 4, "FIG. 6" should read -- FIGS. 6A and 6B --.

UNITED STATES PATENT AND TRADEMARK OFFICE

CERTIFICATE OF CORRECTION

PATENT NO. : 6,219,506 B1
DATED : April 17, 2001
INVENTOR(S) : Hiroumi Morinaga et al.

It is certified that error appears in the above-identified patent and that said Letters Patent is hereby corrected as shown below:

Column 13,
Line 18, "Embodimnt 2)" should read -- (Embodiment 2) --;
Line 66, "ourwardly" should read -- outwardly --.

Column 14,
Line 19, "Figure," should read -- the figures --.
Line 20, "occues" should read -- occurs --.
Line 28, "respect," should read -- respects, --.
Line 55, "bits" should read -- bite --.

Column 15,
Line 27, "11dab," should read -- 11db, --.
Line 42, "15" should read -- 15 of --.
Line 51, "of the rigidity" should be deleted.

Column 16,
Line 21, "projections" should read -- projection --.
Line 50, "of" should read -- to --, and "the" (2nd occurrence) should read -- if --.
Line 58, "know" should read -- knob --.
Line 59, "line" should read -- lines --.

Column 17,
Line 3, "a ice" should read -- an ice --.
Line 25, "preferably" should read -- preferable --.
Line 55, "by which" should be deleted.
Line 58, "apexs" should read -- apexes --.

Column 18,
Line 11, "the" (1st occurrence) should be deleted.
Line 21, "projectionj" should read -- projection --.

Column 19,

| Table 1: "BASIC THICK (ms) | REQUIRED CUTTING TIME (sec) | |
|---|---|---|
| | USUAL BLADR | USW CUTTER" |

should read

| --BASIC THICK (mm) | REQUIRED CUTTING TIME (sec) | |
|---|---|---|
| | USUAL BLADE | USW CUTTER--. |

UNITED STATES PATENT AND TRADEMARK OFFICE

CERTIFICATE OF CORRECTION

PATENT NO. : 6,219,506 B1
DATED : April 17, 2001
INVENTOR(S) : Hiroumi Morinaga et al.

It is certified that error appears in the above-identified patent and that said Letters Patent is hereby corrected as shown below:

Column 19 cont'd

Table 1: "1-1-1 CIRCULAR LDPE
1-1-2 FLAT
1-1-3 BOTTOM"

should read

--1-1-1 CIRCULAR LDPE
FLAT
1-1-2 BOTTOM
1-1-3--.

Table 1: "0.5 5-10 should read --0.5 5-10.
1.0 8-10 1.0 8-13
1.5 10-15" 1.5 10-15--

Table 1: In row 1-2-1, "EDPE" should read --HDPE--.
In row 1-5-1, "ADS" should read --ABS--.

Table 1: "2-1-1 CIRCULAR should read --2-1-1 CIRCULAR
2-1-2 FLAT FLAT
2-1-3 BOTTOM" 2-1-2 BOTTOM
2-1-3--.

Table 1: "3-1-1 GENERAL- should read -- 3-1-1 GENERAL-
3-1-2 LY LY
3-1-3 TRIANGLE" 3-1-2 TRIANGLE
3-1-3 --.

Column 21,

Table 2: "BASIC REQUIRED CUTTING
THICK TIME (sec) should read
(ms) USUAL BLADR USW CUTTER"

--BASIC REQUIRED CUTTING
THICK TIME (sec)
(mm) USUAL BLADE USW CUTTER--.

Table 2: "1-1-1 CIRCULAR LDPE
1-1-2 FLAT
1-1-3 BOTTOM"

should read

--1-1-1 CIRCULAR LDPE
FLAT
1-1-2 BOTTOM
1-1-3--.

UNITED STATES PATENT AND TRADEMARK OFFICE

CERTIFICATE OF CORRECTION

PATENT NO. : 6,219,506 B1 
DATED : April 17, 2001
INVENTOR(S) : Hiroumi Morinaga et al.

It is certified that error appears in the above-identified patent and that said Letters Patent is hereby corrected as shown below:

Column 21 cont'd,

Table 2: In row 1-2-1, "EDPE" should read --HDPE--.
In row 1-5-1, "ADS" should read --ABS--.

| | | | |
|---|---|---|---|
| Table 2: "2-1-1 | CIRCULAR | should read | --2-1-1 CIRCULAR |
| 2-1-2 | FLAT | | FLAT |
| 2-1-3 | BOTTOM" | | 2-1-2 BOTTOM |
| | | | 2-1-3-- |
| Table 2: "3-1-1 | GENERAL- | should read | --3-1-1 GENERAL- |
| 3-1-2 | LY | | LY |
| 3-1-3 | TRIANGLE" | | 3-1-2 TRIANGLE |
| | | | 3-1-3--. |

Table 2: "3-5-4 2.0 >30" should read -- 3-5-4 2.0 ≥30 --.

Column 23,
Line 4, "occur" should read -- occurred --.
Line 32, "When the is".

Column 24,
Line 31, "ourter" should read -- outer --.
Line 37, "of" (1st occurrence) should read -- according to --.

Signed and Sealed this

Twentieth Day of May, 2003

JAMES E. ROGAN
*Director of the United States Patent and Trademark Office*